US006638173B2

(12) United States Patent
Robinson

(10) Patent No.: US 6,638,173 B2
(45) **Date of Patent: *Oct. 28, 2003**

(54) PUTTING IMPROVEMENT DEVICES AND METHODS

(76) Inventor: Lee D. Robinson, 3445 Cascade Ter., West Linn, OR (US) 97068

( * ) Notice: Subject to any disclaimer, the term of this patent is extended or adjusted under 35 U.S.C. 154(b) by 0 days.

This patent is subject to a terminal disclaimer.

(21) Appl. No.: 09/931,380

(22) Filed: Aug. 15, 2001

(65) Prior Publication Data

US 2002/0049101 A1 Apr. 25, 2002

Related U.S. Application Data

(63) Continuation-in-part of application No. 09/384,931, filed on Aug. 26, 1999, now Pat. No. 6,296,579

(60) Provisional application No. 60/226,717, filed on Aug. 21, 2000.

(51) Int. Cl.[7] ..... A63B 69/36

(52) U.S. Cl. ..... 473/131; 473/407; 473/409

(58) Field of Search ..... 473/131, 407, 473/409, 150, 168, 169, 175, 173, 221, 226; 434/173

(56) References Cited

U.S. PATENT DOCUMENTS 3,685,168 A * 8/1972 Lutz
4,655,451 A * 4/1987 Townsley
4,666,157 A * 5/1987 Bodine et al.
4,783,071 A * 11/1988 Tattershall
4,910,677 A * 3/1990 Remedio et al.
5,013,070 A * 5/1991 Maude, Sr.
5,095,430 A * 3/1992 Bonito et al.
5,127,044 A * 6/1992 Bonito et al.
5,146,557 A * 9/1992 Yamrom et al.
5,184,817 A * 2/1993 Kanelous
5,294,110 A * 3/1994 Jenkins et al.
5,438,518 A * 8/1995 Bianco et al.
5,536,010 A * 7/1996 Lambourne
5,558,333 A * 9/1996 Kelson et al.
5,664,880 A * 9/1997 Johnson et al.
5,683,303 A * 11/1997 Lambourne
5,772,534 A * 6/1998 Dudley
5,779,566 A * 7/1998 Wilens
5,788,583 A * 8/1998 Agulnek et al.
5,797,809 A * 8/1998 Hyuga
RE36,346 E * 10/1999 Germain
6,027,417 A * 2/2000 Zoretic et al.
6,059,672 A * 5/2000 Zeiner-Gundersen
6,267,687 B1 * 7/2001 Alex
6,296,579 B1 * 10/2001 Robinson

* cited by examiner

*Primary Examiner*—Michael O'Neill
(74) *Attorney, Agent, or Firm*—Kolisch Hartwell, P.C.

(57) ABSTRACT

Methods and devices for improving putting. The device includes a representation of a green on which a plurality of putting benchmarks are projected. The representation may also include elevation indicia and indicators of the speed and predominant grain direction of the green. The device is used to enable golfers to accurately read the green and determine the speed and direction along which a particular ball should be putted. Methods of using and creating the device are also disclosed, as are additional embodiments of putting improvement devices.

43 Claims, 11 Drawing Sheets

PUTTING IMPROVEMENT DEVICES AND METHODS

RELATED APPLICATIONS

The present application claims priority to U.S. patent application Ser. No. 09/384,931, which was filed on Aug. 26, 1999 now U.S. Pat. No. 6,296,579, and the disclosure of which is hereby incorporated by reference. The present application also claims priority to copending U.S. Provisional Patent Application Ser. No. 60/226,717, which was filed on Aug. 21, 2000, is entitled "Putting Improvement Devices and Methods," and the disclosure of which is hereby incorporated by reference.

FIELD OF THE INVENTION

The present invention relates generally to golfing, and more particularly to methods and devices for improving putting.

BACKGROUND AND SUMMARY OF THE INVENTION

An important element of every golfer's game is putting. With approximately half of most golfer' strokes occurring on or near the green, putting can often make the difference between playing well and playing poorly. As golfers improve their skills, being able to putt well continues to be extremely important. Many tournaments are decided by differences of one or two strokes, with the advantage often being gained or lost on account of whether a difficult putt is made. Therefore, regardless of a golfer's level of skill, being able to accurately read a green to determine the angle and force to use for a particular putt remains an important part of a golfer's game.

However, accurately reading a green is difficult to do, especially when the golfer is not familiar with the particular course being played or when the golfer is not very skilled at playing golf. Such factors as the type of grass being used, the time of day, the overall slope of the green and surrounding course, subtle variations in the scope of the green, etc. all must be accounted for to read a green accurately. The present invention is a device and method for improving putting. More specifically, it provides a mechanism for a golfer to accurately gauge how a particular putt will travel over the green based on determined lines of travel.

Many features of the present invention will become manifest to those versed in the art upon making reference to the detailed description which follows and the accompanying sheets of drawings in which preferred embodiments incorporating the principles of this invention are disclosed as illustrative examples only.

DETAILED DESCRIPTION OF THE INVENTION

Figure 1:
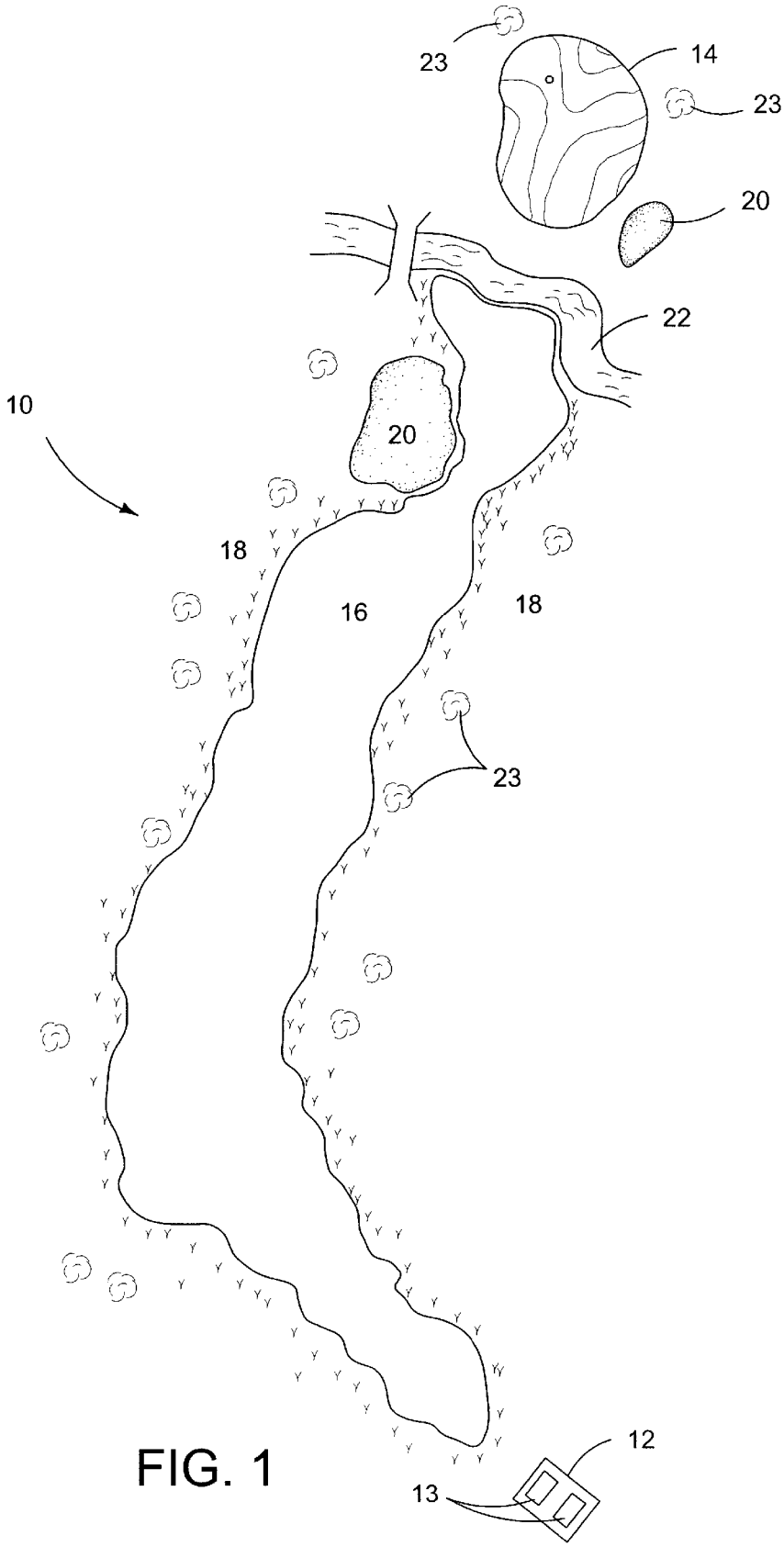
FIG. 1 is a schematic top plan representation of a golf hole.

An example of a typical golf hole is shown in FIG. 1 and generally indicated at 10. Hole 10 includes a tee area 12 having at least one tee box 13 and a green 14 distal the tee area. Between tee area 12 and green 14 lies a fairway 16 bounded on each side by rough 18. Also shown in FIG. 1 are bunkers, or sand traps, 20, a water hazard 22, and trees 23.

Figure 2:
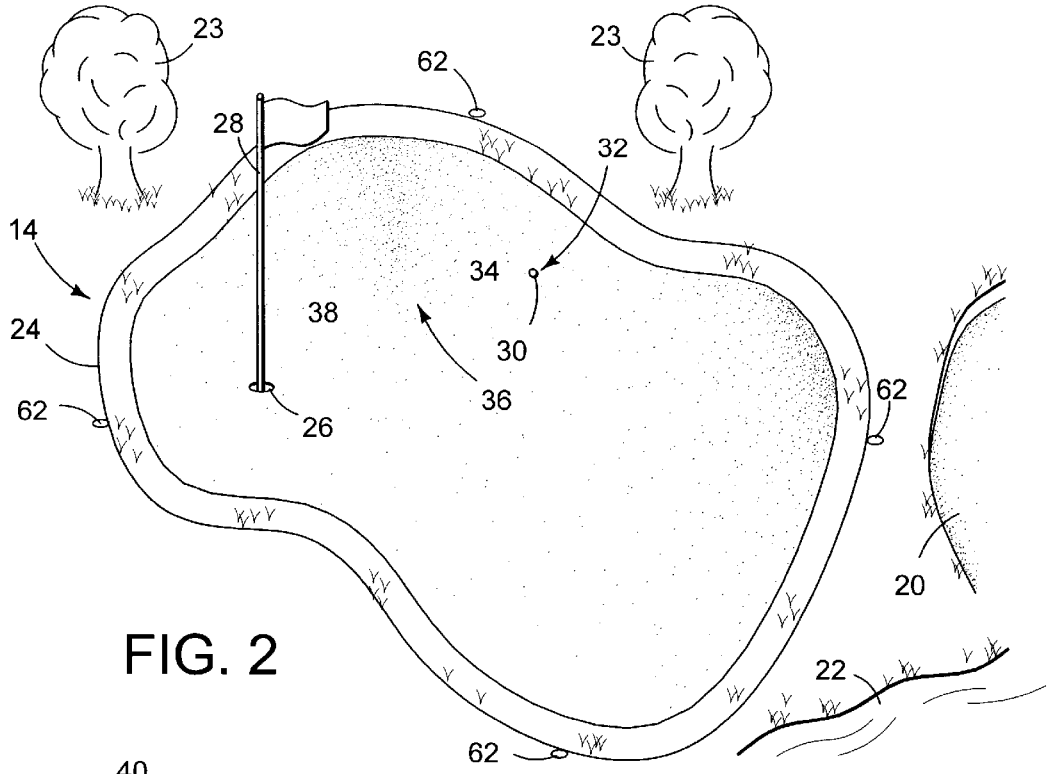
FIG. 2 is an isometric view of the green shown in FIG. 1.

Green 14 is shown in more detail in FIG. 2 and is surrounded by an apron 24, which is a region of grass that is typically longer than the grass forming the green and shorter than the grass forming the fairway. Green 14 also includes a hole, or cup, 26 into which a pin 28 is removably received. Although green 14 may be horizontal, greens typically have a 1–3% slope incorporated therein for drainage and have complex curved surfaces with curved rises and depressions that make it difficult to accurately predict how a putted golf ball will travel over the green. Therefore, in addition to the curvature of particular regions of the green, green 14 may also extend at an overall angle to a horizontal plane. Similarly, the surrounding structures may be inclined to confuse golfers into thinking the green is more or less inclined than it really is.

For example, a golf ball is indicated at 30 in FIG. 2 on a region 32 of green 14. As shown, the distance from ball 30 to hole 26 along the surface of the green is not level. Instead, the ball must travel up a slope 34, then along a region 36 inclined at a different angle than region 32, and then down another slope 38 to cup 26. Because of the slopes and curvature of the regions of green 14 over which ball 30 must travel, it is difficult to accurately predict the path along which the ball will travel when putted.

Figure 3:
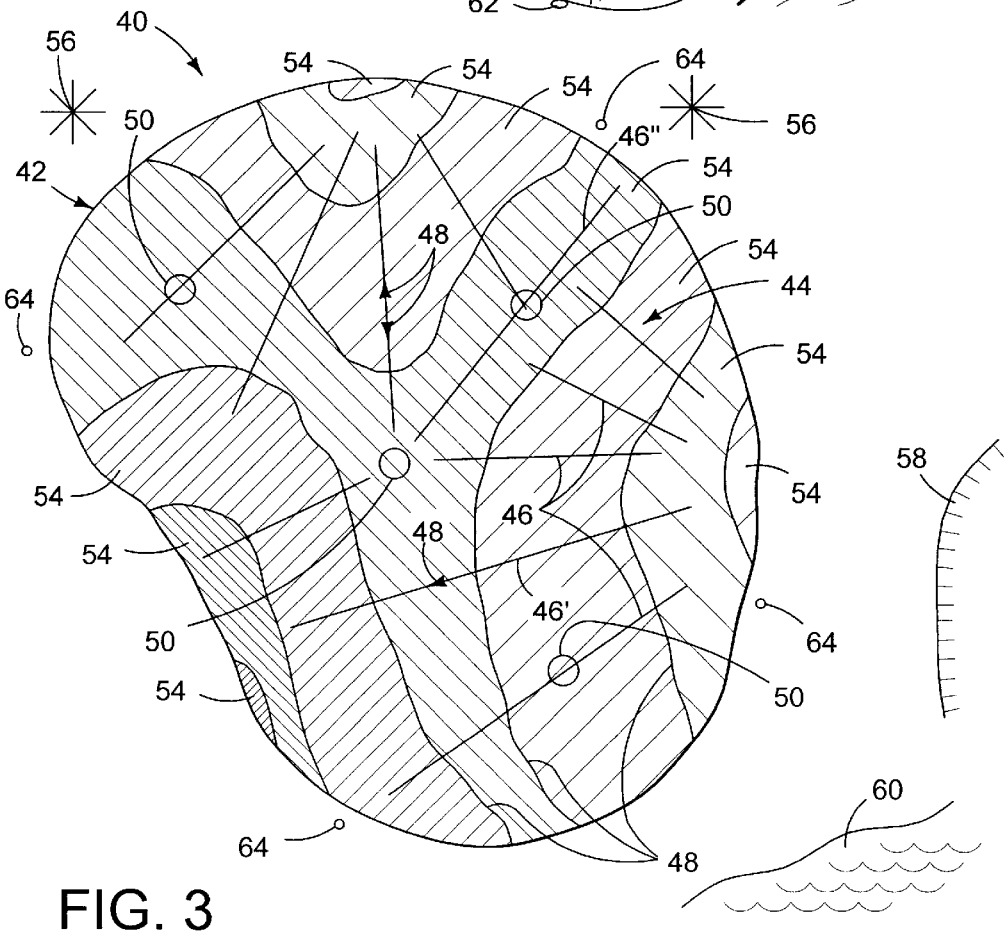
FIG. 3 is a top plan view showing an embodiment of a putting improvement device constructed according to the present invention and including a representation of the green of FIG. 2.

A golfing aid constructed according to the present invention is shown in FIG. 3 and generally indicated at 40. Aid 40, which also may be referred to as a putting improvement device, improves a golfer's putting by enabling the golfer to more accurately predict the path of a putted ball. Responsive to predetermined paths of travel indicated on device 40, which are referred to herein as putting indicia, the golfer is able to determine the path along which a putted ball will travel on the green.

As shown in FIG. 3, device 40 includes a graphic representation 42 of green 14 and includes at least one puffing indicia 44, which in FIG. 3 is in the form of at least one putt line 46. In FIG. 3, plural putt lines 46 are shown and, in the illustrated embodiment, each indicates a line of straight putt. By this it is meant that a ball putted along a corresponding line 46 on green 14 will follow the line without diverging, or breaking, to either side. It should be understood that representation 42 and putting indicia 44 are illustrated herein for illustrative purposes only, with actual empirical measurements required to determine the exact placement of the putting indicia on representation 42. Putting indicia 44 may also be referred to as putting benchmarks because they represent determined, or fixed, paths along which golf balls will travel on green 14. Therefore, golfers who have never previously putted on green 14 or who are not skilled at reading greens can rely upon these defined benchmarks to determine the path along which a particular ball should be putted on green 14.

Straight putt lines 46 may indicate straight putts in one direction, or in both directions, and therefore may include directionality arrows, such as shown at 48 in FIG. 3. Also, arrows may be used to indicate the direction of elevation change along the length of the putt lines. Factors that may affect whether any of the putting indicia disclosed herein are one- or two-directional, include whether green 14 includes a predominant grain direction, and the slope of green 14 at the end points of the indicia. The slope, or break, in a particular region of the green will affect slow moving balls more than faster moving balls. Therefore, some straight putt lines 46 may only represent straight paths for balls traveling in one direction along the line, with balls traveling the other direction tending to diverge from the particular putt line 46. Similarly, balls traveling in one direction with respect to the grain of the green may travel along a path that corresponds to one of the putt lines, but travel along a different line if putted in the reverse direction.

The actual distance represented by particular putt lines 46 may vary. Generally, lines 46 should represent at least two feet, and often times will represent distances between approximately five feet and approximately twenty feet. Lengths outside of this range are also within the scope of the invention. For example, in regions of extreme elevation changes or complex curvature, it may be desirable to have shorter putt lines to detail lines of straight putts extending through that region, with longer putt lines used in regions with less complex curves or changes in elevation.

It is preferable that lines 46 are as long as possible so that the most comprehensive information is provided to a golfer using device 40. The length of line 46 is at its maximum when a ball putted along the line reaches the end of the depicted line and then deviates from the straight line along which it had been following.

Although multiple straight putt lines 46 are shown in FIG. 3, it should be understood that larger or smaller numbers of such lines may be used. In general, the number should be selected after considering such factors as the size of the green, whether difficult regions of the green have been accounted for, whether all desired pin positions have been accounted for, and the degree of specificity to which device 40 is to be created. For example, for most players it may be acceptable to have several putt lines for each regularly recurring pin position. However, for players desiring additional guidance, additional straight putt lines may be used, such as to provide additional guidance for these recurring positions or to provide guidance on other locations of the green.

Because the pin positions used on a particular green tend to be frequently repeated and to be relatively low in number, putt lines 46 are preferably selected to extend proximate, or even through, a recurring pin position. As an illustrative example, four recurring pin locations are generally indicated at 50 in FIG. 3, with lines 46 extending through or near one or more of these positions. It should be understood that the exact placement of hole 26 may vary, but will tend to be located within or very close to the recurring pin positions 50 shown in FIG. 3. Therefore, although there are countless lines of straight putts that may be identified for a particular green, knowing the most common pin positions allows putting indicia to be selected that generally correspond to these positions. Device 40 may include putting indicia 44 that extend through regions of the green spaced-apart from one of the recurring pin positions 50, however, it is preferred that at least a few of the indicia correspond to these recurring positions 50.

In FIG. 3, it can be seen that device 40 further includes elevation indicia in the form of contour, or elevation, lines 52 that define regions 54 of different elevation on green 14. As shown, shading is used to represent changes in elevation, with darker shades representing lower elevations and lighter shades representing higher elevations. Therefore, if a ball needs to travel from a light region to a darker region, it will travel down a slope. The shading used in FIG. 3 is presented as an illustrative example of one suitable way to differentiate the elevation of regions 54, however, any other suitable method may be used.

It is within the scope of the present invention that device 40 may include more or less contour lines 52 than shown in FIG. 3. Typically, the number of contour lines and the elevation difference between each contour line are selected to most easily show the indentations and slopes of a particular green. Factors that may affect the number of contour lines used on the representation of a particular green include user preferences, the overall change in elevation on the green, the severity of the contours, and irregularities in the elevation on the green. For example, a relatively level or gently sloped green will typically require less contour lines than a green with multiple rises and depressions or a green with a greater overall range of elevations. However, the more contour lines used on a particular representation, the more information provided to a golfer to accurately read a green.

In FIG. 3, it can also be seen that putt lines 46 often extend through more than one region 54. When this occurs, the portions of putt lines 46 extending through different regions may be referred to as fall-line indicators, in that they demonstrate how a ball will travel as it rolls up or down an incline on green 14. Most of the putt lines shown in FIG. 3 extend through a plurality of elevations, with the exact number of general regions of elevation varying depending on the particular region of the green through which a particular putt line 46 extends. For example, in FIG. 3 it can be seen that one putt line 46' extends through four contour regions, while another 46" extends through only a single region. Of course, as the number of contour lines 52 is increased, it is more likely that the putt lines will extend through multiple regions 54. Also, because a particular golfer's putt only needs to travel within a single region does not mean that the putt would automatically travel along a straight line within that region. Even within a single region 54, balls will tend to travel along irregular, non-straight lines because of such factors as the degree of elevation change between contour lines 52, irregularities in elevation within a particular region 54, the grain of the green in the region and the direction the ball must be putted with respect to the grain. Therefore, straight-putt lines 46 within a single region 54 are also useful to help a golfer accurately read a green and putt more accurately.

Device 40 may further include indicia representing landmarks surrounding green 14. For example, in FIG. 3, bunker 20, water hazard 22 and trees 23 are represented respectively at 56, 58 and 60. Also shown in FIG. 2 are sprinkler heads 62, which are depicted in FIG. 3 at 64. These landmarks enable a golfer to more easily orient representation 42 with respect to green 14 so that the position of pin 28 and the golfer's ball on green 14 may be translated to corresponding positions on representation 42. Once these positions are known, the elevation and/or putting indicia may be used to read the green and thereby determine the proper path and speed along which the ball should be putted.

Other graphical indicia may be used to indicate the slope of green 14. It is also within the scope of the present invention that device 40 may include a representation of green 14 that does not include any contour or elevation lines or markings, and instead includes only the putting indicia 44 described herein. However, both the putting indicia described herein and any suitable form of elevation indicia are preferred because the elevation indicia, such as contour bands or shading, better enable a golfer to interpolate the path of putts that do not travel directly along one of the putting indicia described herein. Both indicia are also useful to determine whether the putt is traveling uphill or downhill, which is important when determining the speed of the putt. This is particularly helpful when the region of the green over which a ball will be putted extends only slightly uphill or downhill, in which case it may be difficult for the golfer to otherwise know that the green extends at an angle to the horizontal.

Figure 4:
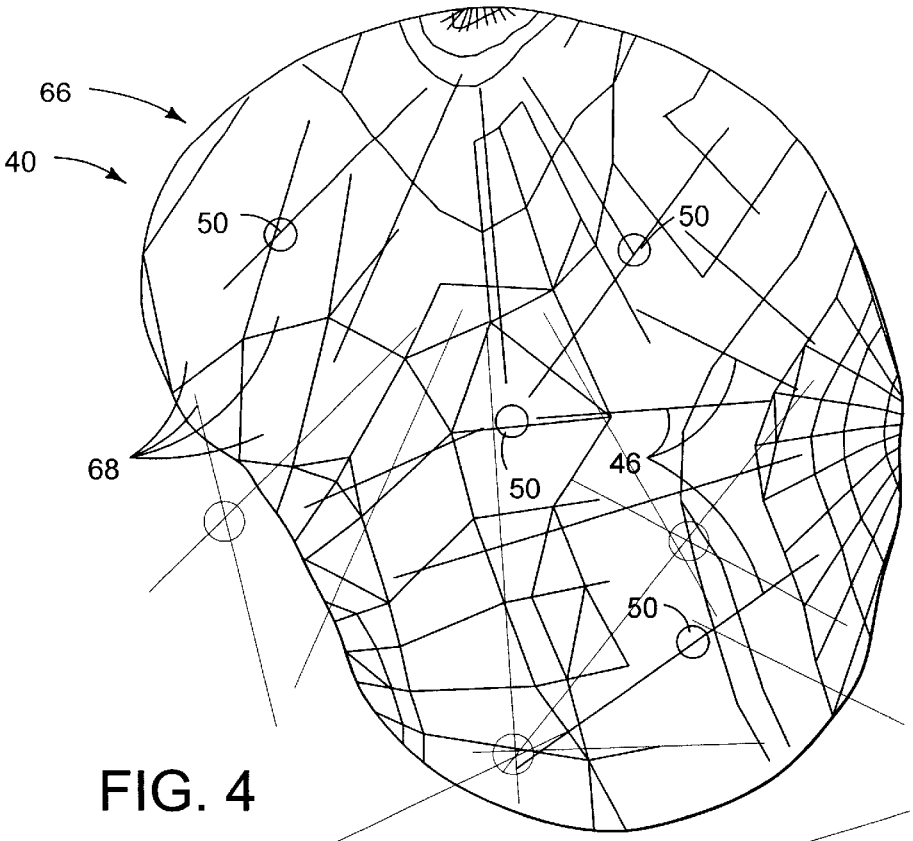
FIG. 4 is a schematic top plan view showing the device of FIG. 4 including another representation of the green of FIG. 2.

In FIG. 4, device 40 is shown with another suitable representation of the elevation of green 14, which is generally indicated at 66. Representation 66 includes a graphic representation of the green 14 reduced to planar geometric surfaces 68. This modeling technique is known in the art of computer simulation, although its use to model golf greens is not known. FIG. 4 is presented to demonstrate that the particular method of representing the curvature and elevation differences on green 14 should not be limited only to contour lines 52. It should be understood that when the representation of FIG. 4 is used with the invented putting aid, it may include any of the putting indicia 44 described and illustrated herein.

Still another suitable representation of the elevation of green 14 is with a plurality of arrows that indicate the general slope of the green in the region upon which the arrow is shown. An example of this technique is demonstrated in U.S. Pat. No. 5,797,809 to Hyuga, the complete disclosure of which is hereby incorporated by reference. Any of the putting indicia 44 described herein may be used with this representation of green 14 as well.

Because some greens will contain areas of complex curvature through which no straight putt lines 46 of any suitable length may be drawn, those regions may not have any putting indicia depicted in the representation of the green. Alternatively, it is within the scope of the present invention that putting indicia 44 may include embodiments other than straight putt lines 46, as described in more detail below.

Figure 5:
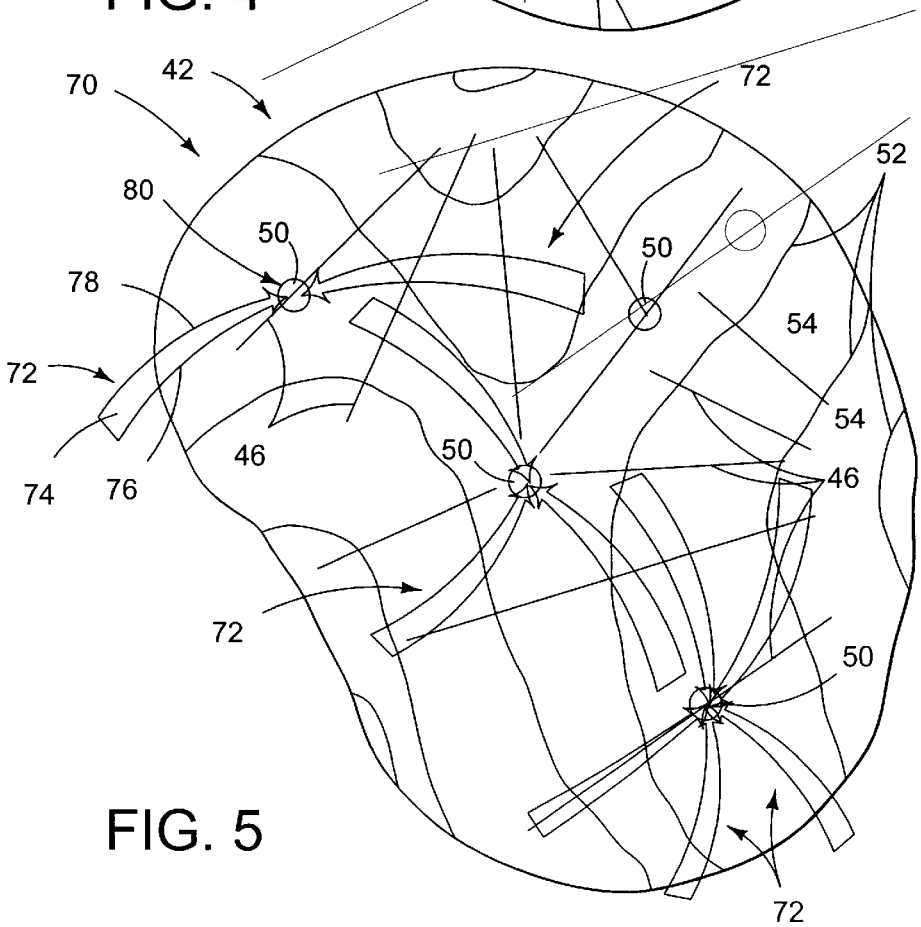
FIG. 5 is a top plan view showing another embodiment of the device of FIG. 3.

Another embodiment of putting improvement device 40 is shown in FIG. 5 and generally indicated at 70. In FIG. 5, representation 42 of green 14 includes another embodiment of puffing indicia 44, in the form of convergence bands 72 that define regions 74 through which putts will travel to a common terminus. As shown, each region 74 is bounded by putt-lines, 76 and 78, which may be either linear or curved. The shading used in FIG. 3 to depict changes in elevation between the particular regions 54 of representation 42 have not been repeated in FIG. 5 for purposes of clarity. It should be understood that in an actual embodiment of the invented device, the colors, shading and identifying symbols used may vary, and those depicted herein are presented merely as non-limiting examples.

Unlike the lines of straight putt 46 shown in FIG. 3, bands 72 define regions 74 (as opposed to lines) of the green through which putts will tend to converge to a common location 80. This location may be one of the recurring pin positions 50, but it is within the scope of the present invention that it could also be other locations on the green. For example, it may be desirable to have a convergence band 72 showing how putts traveling down a slope will converge to a common location after the slope levels out. From this location, the green may be level and relatively easy to read, or the representation may include another puffing indicia, such as a straight putt line 46 showing how the now-coverged paths of the putted balls will travel from that location.

Figure 6:
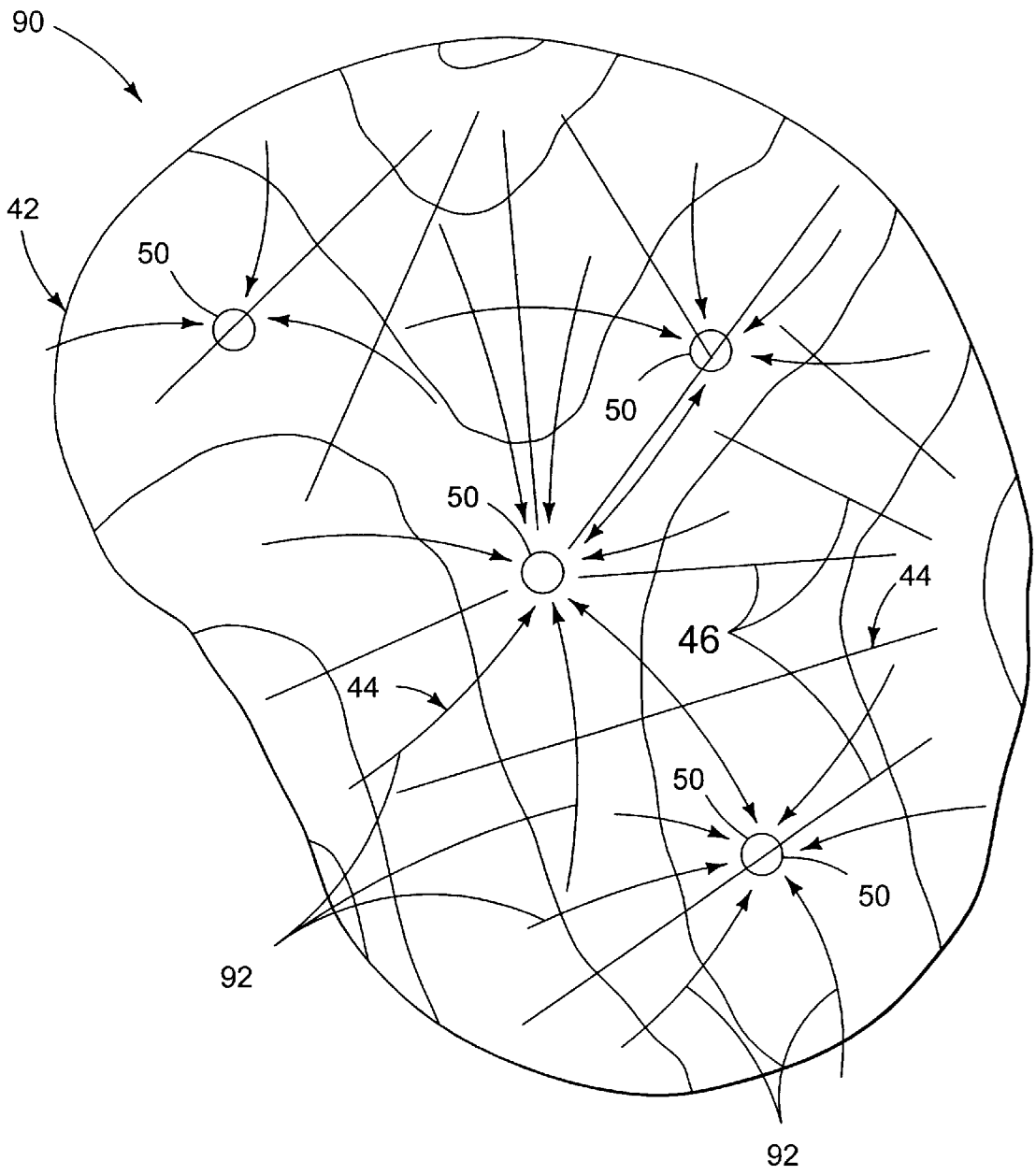
FIG. 6 is a top plan view showing another embodiment of the device of FIG. 3.

It should be understood that putting indicia 44 may have other configurations than the straight putt lines 46 shown in FIG. 3 or the convergence bands 72 shown in FIG. 5. For example, puffing indicia 44 may also include putt lines that are not straight, and instead curve or bend to show the breaking path of balls putted along these lines. An example of such an embodiment of device 40 is shown in FIG. 6 and generally indicated at 90. In FIG. 6, the pin locations 50 of FIG. 3 are shown, only further including a plurality of putting indicia 44 in the form of curved putt lines 92 radiating outwardly therefrom. Also shown in FIG. 6 is a plurality of straight putt lines 46. Similar to the other embodiments of putting indicia 44 described herein, curved putt lines 92 may also extend along the representation of the green in locations other than those starting or ending at recurring pin positions 50. For example, it may be desirable to use curved lines 92, or a combination of multiple ones of the putting indicia described herein to indicate how putts will travel up or down slopes and inclines, even if those slopes and inclines are not necessarily adjacent a recurring pin position. Curved putting indicia 44 may also be either one- or two-directional, and may include corresponding direction indicators, as discussed above.

It is within the scope of the present invention that one or both of the contour and putting indicia may also extend beyond the perimeter of the represented green, such as to include apron 24 of green 14 or even to include the terrain surrounding the apron. Although only the particular green 14 is discussed herein, it should be understood that green 14 is presented as an example of device 40 adapted for use on that particular green. The invented putting improvement device may be adapted for use on any green, as discussed in more detail below, and as shown has been particularly adapted for use with green 14.

Figure 7:
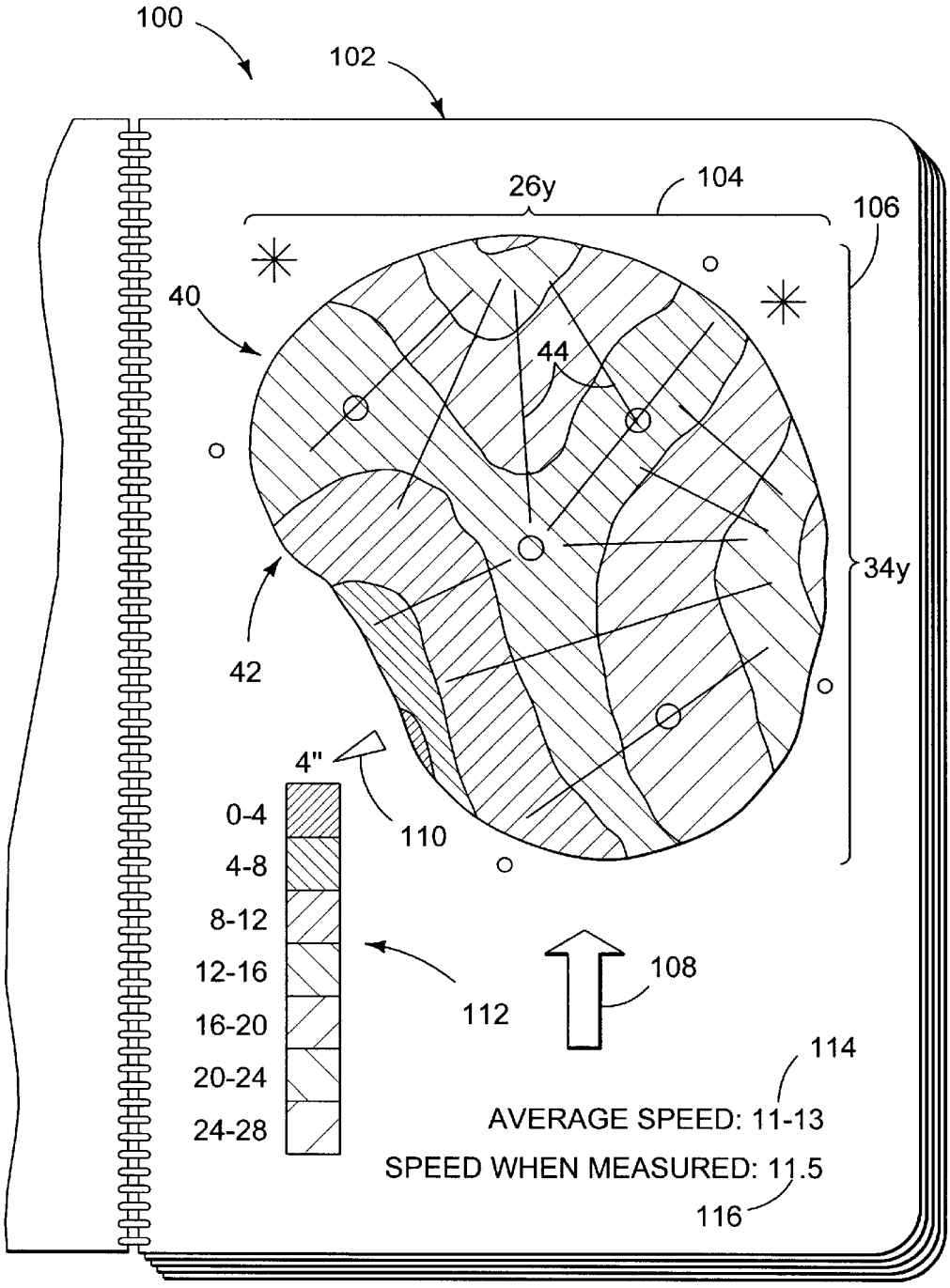
FIG. 7 is a top plan view showing another embodiment of a putting improvement device constructed according to the present invention.

Any of the versions of the putting improvement device disclosed herein may be embodied on a page of a booklet, such as indicated generally at 100 in FIG. 7. Booklet 100 preferably includes one or more representation for each green on the course. In the embodiment shown in FIG. 7, booklet 100 includes multiple pages 102 secured together. It is within the scope of the present invention that booklet 100 is meant to include both single- and multi-paged books, posters, cards, placards, signs, leaflets, and the like. For example, booklet 100 may include a chart depicting all of the greens on a particular course, a hand-held pamphlet with individual pages or regions for each green on a course, a sign located near a particular green and adapted to depict only that green, etc.

As shown in FIG. 7, page 102 includes a representation of a green, including at least one of the embodiments of putting indicia 44 described herein. As shown, page 102 includes representation 42, straight putt lines 46 and contour lines 52, which were previously discussed with respect to FIG. 3.

Other information that may, but not necessarily, be included on page 102 includes horizontal and vertical scales 104 and 106 showing the dimensions of the actual green represented. Another suitable method of indicating the scale of the representation is to identify the ratio between the size of the actual green and the size of the represented green, such as by indicating that each inch on the representation corresponds to ten feet on the actual green. Page 102 may also include an indicator, such as arrow 108, showing the direction from which the green is approached from the fairway. An indicator 110 of the prominent grain direction of the green is also shown in FIG. 7. Indicator 110 is useful when the green includes grass with a prominent grain direction, such as Bermuda grass. With such a green, the path along which a ball will travel will be affected, depending if the ball is traveling with, against, or transverse to this prominent grain direction. Therefore, indicating the prominent grain direction enables a golfer to know this actual direction without having to estimate it on the course and to use this information to more accurately determine the force and path of a putt.

Page 102 also includes an elevation scale 112 showing the elevation range defined by contour lines 52. As shown, scale 112 indicates that each region 54 between adjacent contour lines 52 spans four inches of elevation change. As discussed, scale 112 may vary depending upon the level of detail desired. For example, the differential between adjacent contour lines may be intervals of less than four inches, such as one-inch intervals, or it may be in intervals greater than four inches.

In FIG. 7, the average speed 114 of the green and the speed 116 of the green when the putting indicia were determined are shown. These values are determined by any suitable method, such as by using a Stimpmeter or other suitable device. A Stimpmeter measures the distance a ball travels over level ground given a defined impulse. A Stimpmeter is a metal ramp that is about three feet long with a chute down the middle and a notch about six inches from one end. To use a Stimpmeter, a golf ball is placed within the notch and that end of the Stimpmeter is raised from the surface of the green until gravity forces the ball out of the notch, down the chute and onto a level section of the green. The distance the ball travels on the green is the speed value. Typically, greens are measured twice, once in each direction, with the average length of the roll, in feet, being the Stimpmeter reading for the green.

Average speed value 114 provides a golfer with a measurement of the speed of a particular green or course relative to other greens or courses. This is particularly useful when the golfer is playing a course that the golfer has not played before. For example, if the golfer regularly plays a course having greens with an average speed of 8–10, then the golfer will know that balls will tend to travel further on green 14 because the green has a higher average speed value. Therefore, the golfer will know to putt with less force than the golfer would otherwise use on the familiar course.

Another way of describing the usefulness of average speed value 114 is that many golfers have benchmark levels of force that they use to gauge the relative speed of a green. For example, suppose a golfer's standard putt normally travels twenty feet on a green with an average speed of 9. On green 14, however, a twenty foot putt will require less than the force needed for this standard putt because green 14 has a higher average speed value.

Knowing the speed of the green when putting indicia 44 were measured is helpful because it enables a golfer to adjust how a green is read depending on whether the magnitude of measured speed value 116 relative to average speed value 114.

Instead of depicting values 114 and 116 as shown in FIG. 7, these values may also be included elsewhere in booklet 100, such as in a table in which the average and measured speed values for each green are presented. Any of the other information about the greens (hardness, overseeding, growth rates, prevailing wind, etc.) that may vary from green to green may also be presented in this or another table. When these values are relatively constant for all greens represented in booklet 100, then booklet 100 may include a single identification of these values, such as in an information section, as discussed subsequently. It is also within the scope of the invention that booklet 100 does not include values 114 and 116.

Booklet 100 may include more than one representation for each green. For example, multiple representations may be used to identify a larger number of possible pin positions. This may be useful in tournaments or other competitive matches where the pin may be placed in a less-standard position to make the hole more challenging. In fact, one representation may be shown for each possible, or likely, pin position. By including only one pin position per representation, additional putting indicia 44 may be shown to provide detailed guides to how balls from relatively any location on or proximate the green will travel when putted toward the pin position. Another reason to use multiple representations for each green is to provide more detailed coverage, or putting indicia, regardless of the number, if any, of pin positions represented.

The putting indicia shown in any representation may include various combinations of straight putt lines 46, convergence bands 72, and curved putt lines 92. To make the device easier to read when multiple pin positions are shown on a single representation, different colors, markings, thicknesses, etc. may be used to indicate indicia for a particular pin position.

Booklet 100 may also include an instruction section that explains to a golfer how to use the golfing, or putting-improvement device of the present invention. The instruction section explains the various symbols and indicia used in the putting improvement device, as well as how to use the elevation and/or putting indicia to accurately read a green and thereby putt more accurately.

Figure 8:
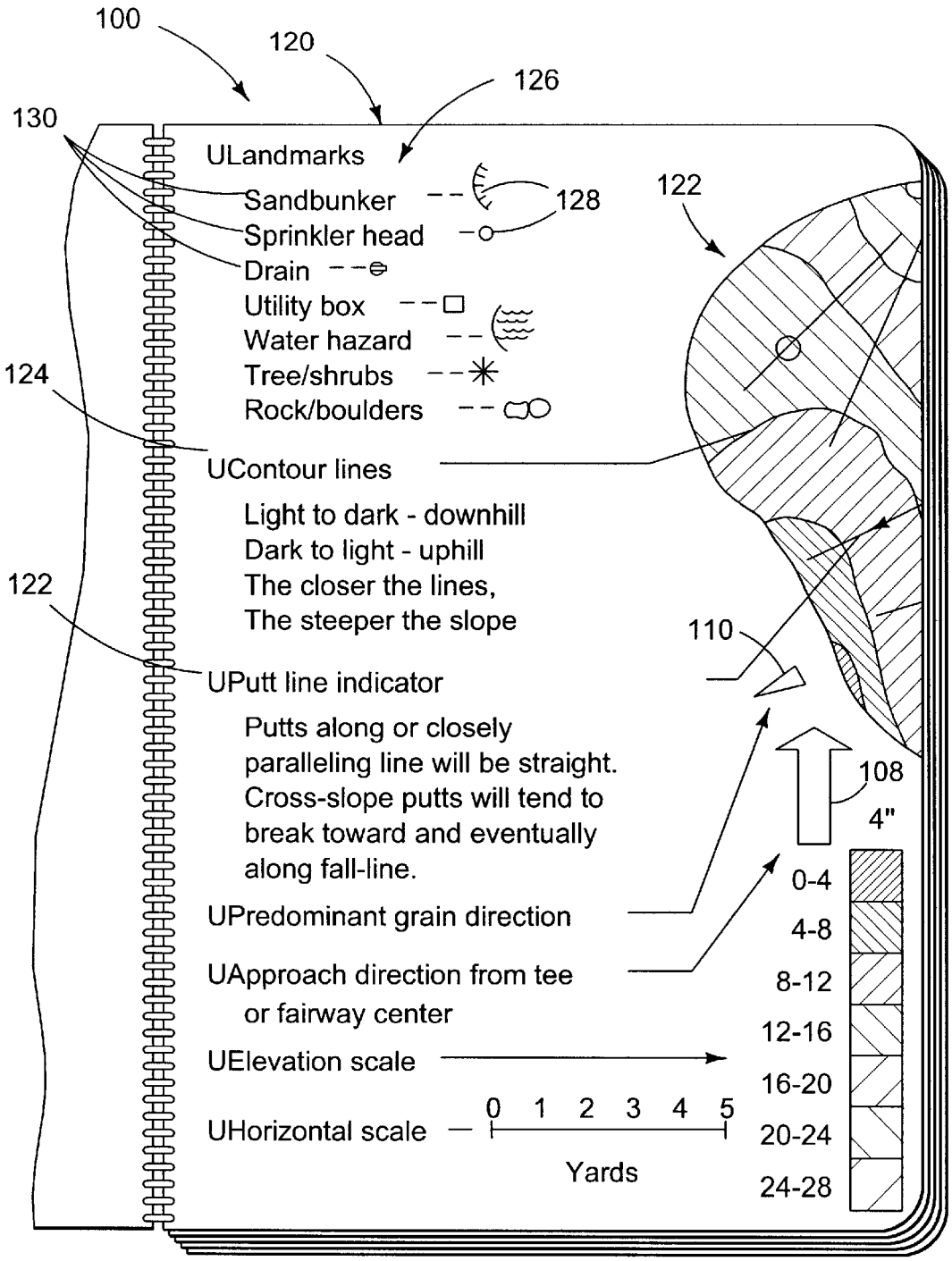
FIG. 8 is a top plan view showing another page of the booklet of FIG. 7.

An example of such an instruction section is shown in FIG. 8 as an additional page 120 of booklet 100. Instruction section 120 teaches a golfer how to use the invented putting improvement device. Section 120 includes an example of a representation of a green, which is generally indicated at 122 and includes at least one embodiment of putting indicia 44. A particularly well-suited representation for green 122 is a practice green existing at the course for which a particular booklet is adapted. This enables golfers to practice using booklet 100 and the putting improvement device 40 embodied therein before beginning to play a particular golf course. In FIG. 8, representation 122 corresponds to the representation shown in FIG. 3 and includes straight putt lines 46 and elevation lines 52. In addition to showing an example of how greens are represented in booklet 100, instruction section 120 further includes an explanation 124 of how to use putting indicia 44 to read greens. Section 120 may also include an explanation 124 of how to interpret the elevation indicia, such as contour lines 52, as well as an explanation of how to combine the information provided by the putting and elevation indicia. Other elements that may be included in section 120 are visual representations of how putted balls will travel, such as when putted along, adjacent and at an angle to the putting indicia.

In FIG. 8, instruction section 120 further includes a legend 126 describing the various depictions 128 of landmarks 130 that are used in the booklet, such as the trees 60 and sprinkler heads 64 depicted in FIG. 3. Also explained in section 120 are direction and grain indicators 108 and 110, and elevation scale 112.

Figure 9:
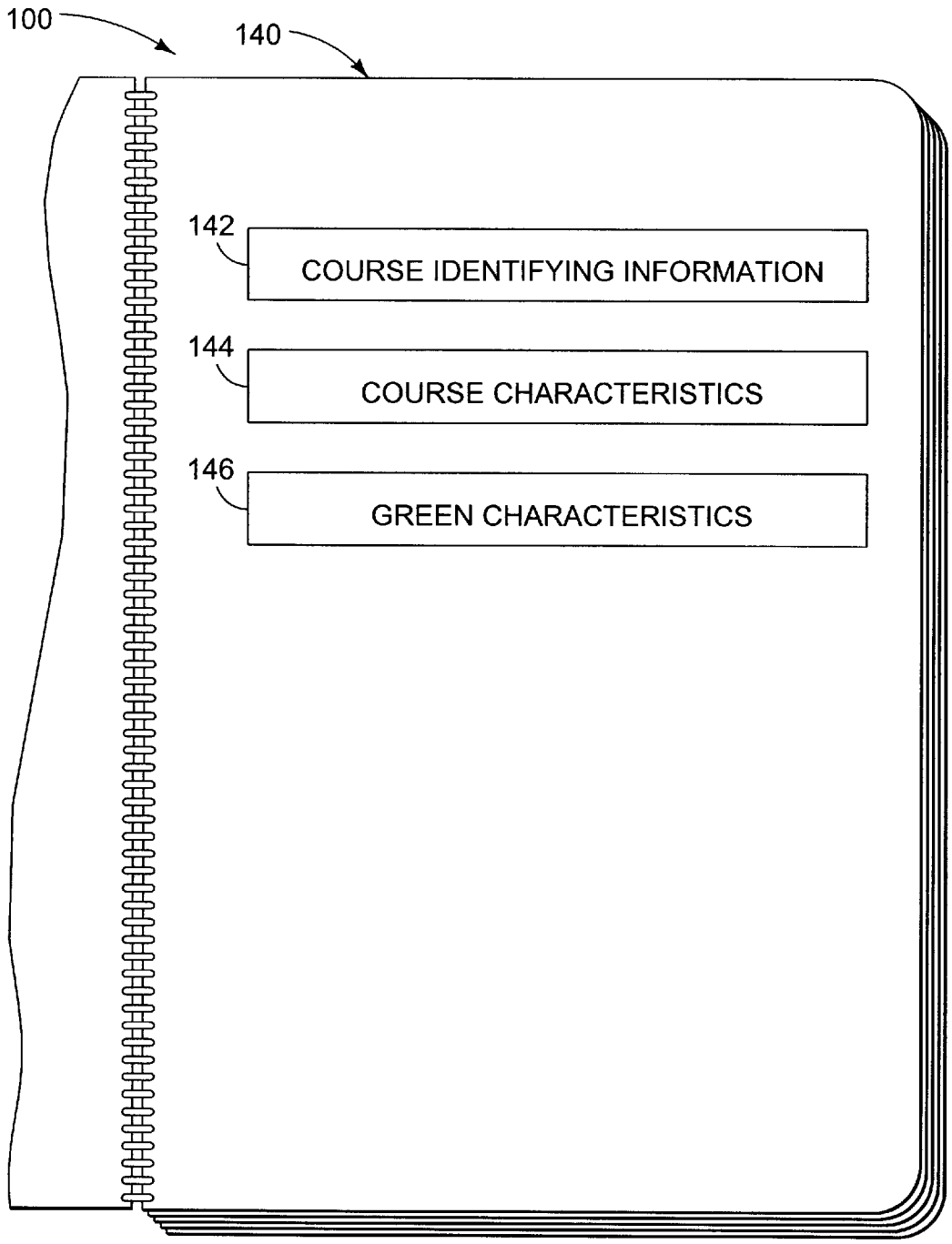
FIG. 9 is a top plan view showing another page of the booklet of FIG. 7.

Instruction section 120 may also include information about the course being played, and especially information about the greens on the course. An example of information that may be included in this section is shown as an additional page 140 of booklet 100 in FIG. 9. Page 140 includes course-identifying information 142 and general course characteristics 144. Examples of course-identifying information 142 include the name, designer and creation date of the course. Examples of general course characteristics 144 include the length and style of the course, handicap rating, type of grass used in the fairway, and amenities.

It is preferable that page 140 also includes particular information 146 about the greens used on the course. An example of a green characteristic that may be presented in this section, or page, is the type of grass used on the greens. This information helps golfers determine how to adjust their putts depending upon the type of grass and the particular characteristics thereof. For example, rye and bent grass tend not to have any directionality, while Bermuda grass tends to have a grain that extends toward the setting sun. Other suitable green characteristics that may be presented in section 140 include smoothness, firmness, overseeding and growth rates. The average and/or measured speeds of the greens may also be included in this section, or elsewhere within booklet 100.

To use any of the embodiments of the putting improvement device discussed herein, a golfer first identifies the positions on the device that correspond to the positions of the golfer's ball and pin 28 on green 14. Typically, this involves first orienting the device with respect to the actual green, such as by aligning the landmarks adjacent the actual green with their corresponding depictions on the device. Once these reference positions are located on the device, such as on representation 42 of device 40, the golfer next determines whether any of the putting indicia 44 connect the golfer's ball to the pin. If so, the device demonstrates the exact path along which the golfer should putt the ball. If not, the golfer uses the putting indicia as determined, tested benchmarks to select the path along which the ball should be putted.

For example, downhill putts transverse to a straight putt line 46 will tend to break downhill and eventually along the straight putt line. Putts extending near and generally parallel to a straight putt line 46 will tend to also go straight, unless the elevation indicia indicates a change in elevation along the path through which the ball will be putted. Putts extending transverse to straight putt lines 46 will break from higher elevation regions toward lower elevation regions, or from light to dark if the coloring or shading scheme described herein is used. Putts lying anywhere within convergence bands 72 will follow the curvature of the extremes 76 and 78 of the band to the terminal position 80. Other information used by the golfer to determine the path and speed of the putt are speed values 114 and 116, such as shown in FIG. 7, and the elevation indicia, such as contour lines 52 shown in FIG. 3.

As discussed above, the invented putting improvement device enables a golfer to more accurately determine the path along which a ball should be putted, even if the golfer's ball and/or pin position does not lie along one of the putting indicia depicted on the representation of the green being played. In those situations, the putting indicia provide benchmarks from which the golfer may interpolate the path along which a ball should be putted. Also speed, elevation and grain information allow the golfer to more accurately gauge the force which should be used for a particular putt. For example, putts against the grain will tend to require more force, i.e. be slowed, than putts traveling in the direction of the grain. Putts extending through several very close contour lines 52 will be traveling down a steeper slope than putts in which the contour lines are spaced further apart.

An important aspect of puffing is mental and depends upon a golfer's confidence that the green has been accurately read. When the golfer is confident that the selected path along which the ball will be putted is accurate, indecision is reduced or eliminated during the execution of the putting stroke. This results in a smoother, more accurate stroke that is not misdirected through pauses, jerks or improper force, which stem from this indecision. The putting improvement device of the present invention reduces indecision by providing established benchmarks that a golfer can use not only to select the path along which a ball will be putted, but also to add confidence to the putt by confirming the user's selected speed and break.

The putting improvement device also helps beginning or less skilled golfers learn how to read greens. Some contours may be too subtle for some golfers to detect, but will affect the course of a putted ball nonetheless.

The elevation and putting indicia depicted in any of the embodiments of the putting improvement device described herein are created using survey equipment and empirical testing. More specifically, survey equipment is used to obtain data corresponding to the shape of the green and the topographical profile of the green. Other data that may be obtained include the locations of recurring pin positions on the green and the locations of landmarks relative to the green.

The data may be obtained using any suitable surveying equipment. One suitable example is the Leica TCA 1105 Total Station manufactured by Leica Geosystems. This equipment has proven particularly effective because it only requires one operator. Another example is the Leica TPS 1100 Professional Series Total Station. Of course, other automated, semi-automated and manual techniques may be used, but techniques producing computerized data are preferred because the data is less likely to contain errors and because the data may be used by software to create any of the embodiments of the device described herein.

A drafting program receives the survey data and uses this data to create the representation of the measured green shown in the putting improvement device. Typically, the representation, such as representation 42, is created responsive to user inputs, such as to determine the type of graphical representation to use, and the level of detail to be used in the representation. For example, when contour lines are used, such as shown in FIG. 3, the user may select the number of contour lines or the elevation span between adjacent lines. Understandably, the accuracy of the representation will depend upon the number of data points obtained and the number of intervals into which this data is divided. Typically several hundred data points are required to accurately represent each green, with increased numbers of data points required for larger greens, greens with severe changes or fluctuations in elevation, or representations in which very small changes in elevation are to be represented. Because the locations of landmarks are determined using the survey equipment, they will be accurately located with respect to the green, and therefore should not be inaccurately positioned through human error.

Once the representation and elevation indicia are created, the user may also use the software to add optional information to the created device, such as demarcations to represent different elevations, legends, scales, indicators, speed, grain, etc. It should be understood that the method of obtaining data and creating the graphical representation of the green and the elevation indicia depicted thereupon is presented as one suitable method, and that any other suitable method may be used as well so long as one of the invented devices described herein are created. For example, the method described above involves computerized survey and drafting equipment, however, either or both of these steps could be performed manually. However, the above method is preferred because it reduces the time and effort required to create the device, while also minimizing the possibility of human error.

The putting indicia described herein are determined manually by measuring the path of balls traveling on the actual green being measured. Preferably, balls being used are propelled along the green using a reproducible amount of force so that measurements may be verified and repeated as necessary. One suitable way to do this is to use a Stimpmeter or similar device in which a golf ball is rolled down a ramp from a determined height. Because the height at which the ball is released is known, it is possible to "putt" many balls using the same force. If the guide is not moved, then golf balls released from the same height should follow the same path along the green.

As an example, when a straight putt line is desired, a golf ball is propelled in a selected direction and with a selected force along the green. If the path of the ball along the green fails to meet the selected criteria, which in this example is a straight line, then a new starting position or direction is selected. If the golf ball initially travels along a path meeting the selected criteria, then the golf ball is propelled along the original path with less force until the position along the path at which the ball will deviate from the selected criteria is determined. Once a path meeting the selected criteria is identified, the length of this path, or putt line, is preferably maximized by propelling a golf ball with additional force to determine the maximum distance the ball will travel along the path until the ball deviates from the path.

When a two-directional putt line is desired, the above process is repeated from the opposite end of the originally determined path to determine whether the ball will also travel along the path in the opposite direction. If so, then a two-directional putt line is known. If not, then the above process is repeated to determine if a shorter two-directional putt line is possible along the originally determined path, or whether no two-directional putt line is possible along that path.

When one-directional curved putt lines are desired, then the selected criteria may be that the path determined by the ball is of a sufficient length to the user, or that the path extends through a selected location on the green. When two-directional curved putt lines are desired, then the prevailing criteria is that a golf ball will travel along the same curved path regardless of the direction in which the ball is putted along the path. Other criteria may also be used, such as a selected length or a position of the green through which the path extends. When a convergence band is desired, the prevailing criteria is that a golf ball putted from anywhere within the selected region will travel to a terminal location on the green. The length of the boundaries of the region and the paths defined thereby are selected as described above with respect to one-directional straight or curved putt lines.

When lines of straight putt are being determined, it is desirable to indicate whether the lines represent one- or two-directional lines of straight putt. For example, on greens that do not have any directionality in their grain, lines of straight putts should be two-directional, in that balls putted in either direction along the line should still travel in straight lines.

When a green having a predominant grain is being modeled, at least some of the lines of straight putt will likely be only one-directional, in that putts traveling in the other direction along the line will not follow a straight line because of the influence of the grain of the grass on the ball's path. Also putts extending across an incline may only be one-directional because the slope, or break, of a particular region of a green will tend to affect the path of a golf ball differently depending on the speed at which the ball is traveling. Therefore, a putt line that starts across an incline and terminates along a relatively level surface will unlikely be two-directional, in that putting in the reverse direction will most likely cause the ball to diverge from the putt line as it travels along the incline as the ball slows to a stop. Also greens with a predominant grain direction are more likely to have one-directional putting indicia because grain will tend to affect putts differently depending upon the direction the ball is traveling.

Once the selected putting indicia are measured and verified by empirical testing, the end points of the indicia are preferably recorded with the above-described survey equipment so that these end points are accurately located on the representation of the green. Typically, the survey data and putting indicia are obtained together, and then the drafting software (or other suitable computerized or manual process) is used to create an embodiment of the invented device, including the representation of the green and the putting indicia and other elements depicted thereupon.

Figure 10:
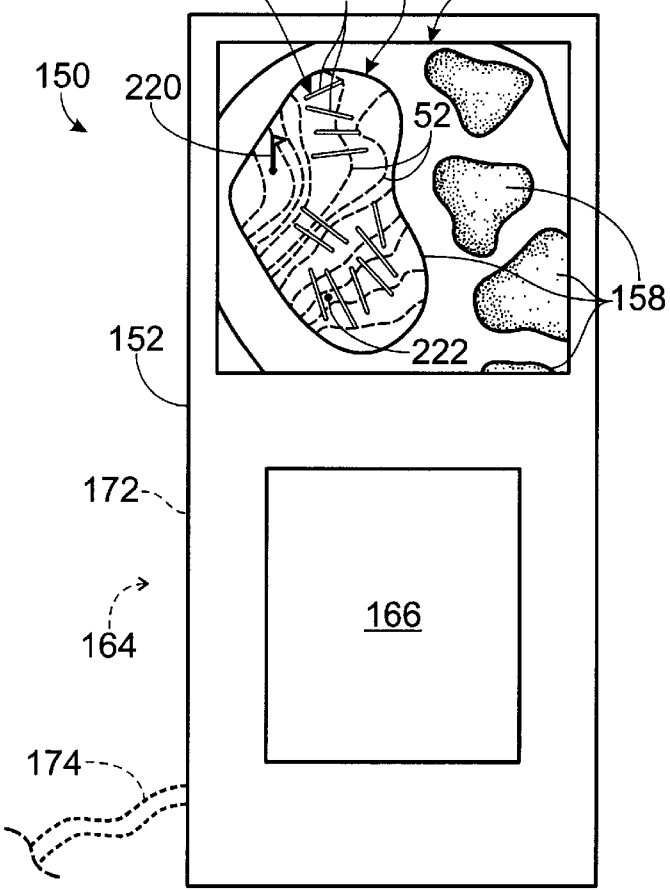
FIG. 10 is a side elevation view of another putting improvement device according to the present invention.

Another putting improvement device 40 according to the present invention is shown in FIG. 10 and indicated generally at 150. Device 150 is an electronic device that includes a housing 152 and a viewing surface 154. Device 150 may be a hand-held device, such as a personal digital assistant (PDA), electronic tablet, personal computing device, or the like. Alternatively, device 150 may be mounted to a golf cart, golf bag, platform adjacent green 14, etc.

Electronic device 150 is adapted to display any of the previously described putting improvement devices 40 and associated indicia, information, scales, etc. on surface 154 for viewing by a user. For example, an electronic representation 156 of green 14, putting indicia 44 and contour lines 52 are shown on surface 154 in FIG. 10. As used herein, the term digital putting information will be used to collectively refer to electronic content containing the putting indicia, green representations, landmarks, contour lines, green information and the like that is displayed on viewing surface 154. In FIG. 10, putting indicia 44 are shown as putt lines 46, however, it should be understood that any one or more of the putting indicia 44 and variants thereof described herein may be used. For example, the putting indicia may have arrow heads to indicate directionality or change in elevation. Digital putting information may, but does not necessarily, include elements other than representations 156 and putting indicia 44. Also shown in FIG. 10 are landmarks 158 to help the user orient device 150 with respect to actual green 14. It should be understood that the shape of the perimeter of green 14, and representation thereof, may be sufficient for the user to properly orient device 150, however, other landmarks may be shown as well.

Figure 11:
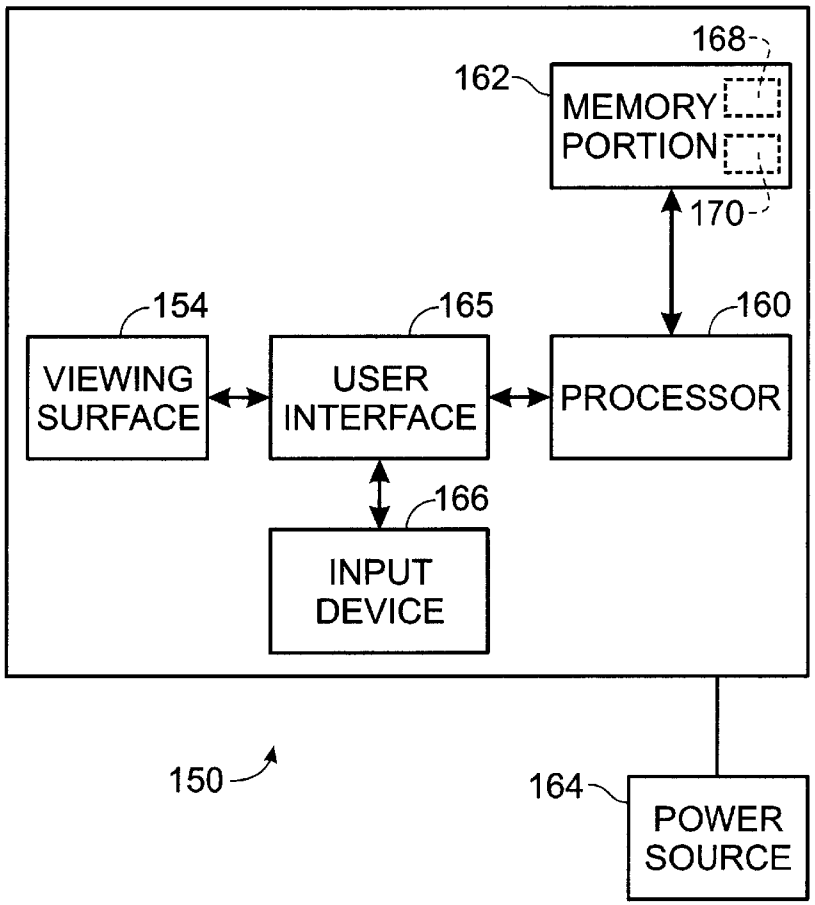
FIG. 11 is a schematic diagram of components of the device of FIG. 10.

In FIG. 11, the components of electronic device 150 are schematically illustrated. As shown, device 150 includes a processor 160, memory portion 162, power source 164 and user input device 166 through which a user communicates with processor 160 via a user interface 165.

Memory portion 162 is adapted to at least temporarily store the digital putting content. Memory portion 162 may include a volatile region 168, a nonvolatile region 170 or both. Memory portion 162 may also store data inputted by the user via input device 166, which is collectively referred to as user data. Examples of user data that may be stored, either temporarily or permanently, include one or more scores for a particular hole, one or more handicaps, user-selected display and/or viewing preferences, and user-inputted putting indicia, such as putt lines 46 measured by the user. By allowing the user to store additional putting indicia, the user is able to add to the amount of information provided, such as the number of putt lines or other putting indicia, so that the user has additional putting indicia for use the next time the user plays the particular hole for which those indicia pertain.

Power source 164 may be any suitable source of electric power for device 150. An example of a suitable power source is a battery assembly 172 that includes one or more batteries. Another example of a suitable power source 164 is an electrical connection to a power source external the device, such as an external battery or an electrical outlet. Because device 150 is designed for use at least primarily on a golf course, a battery-powered device is preferred.

Figure 13:
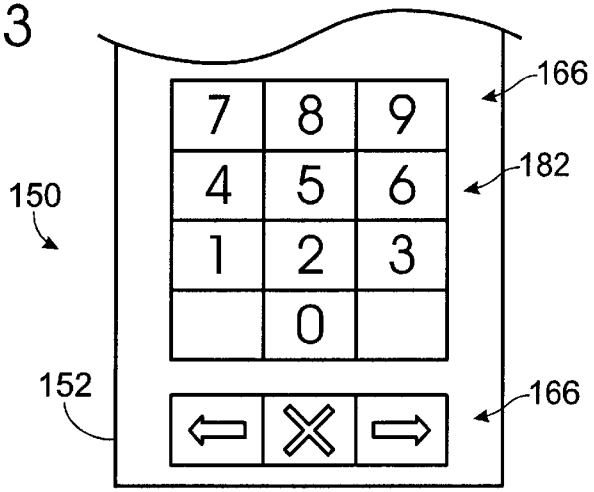
FIG. 13 is the fragmentary view of FIG. 12 showing another example of a user input device.
Figure 15:
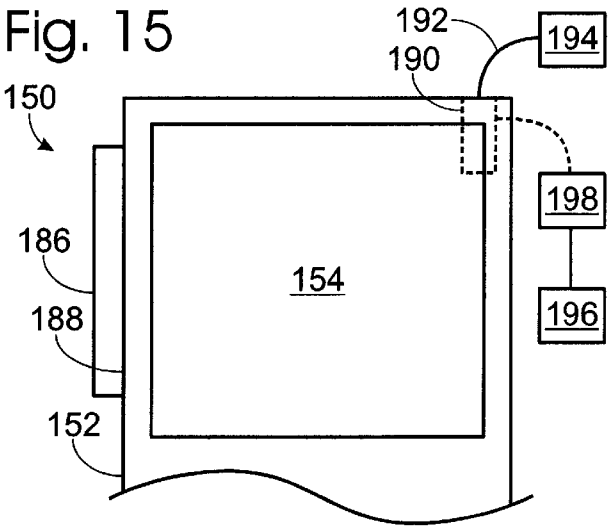
FIG. 15 is a fragmentary side elevation view showing another embodiment of the device of FIG. 10.
Figure 12:
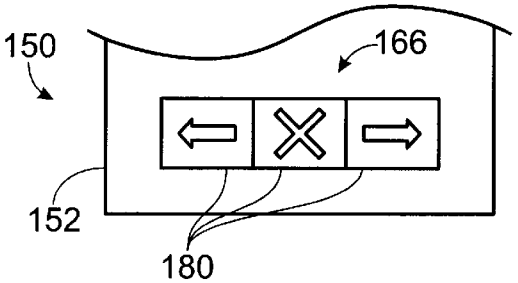
FIG. 12 is a fragmentary side elevation view of the device of FIG. 10 and showing an example of a user input device.

User input device 166 includes any suitable number of mechanisms 176 for conveying user inputs to processor 160. Examples of suitable user input mechanisms include buttons, touch-sensitive regions, dials, keyboards, joysticks, roller balls and the like. Examples of user inputs conveyed to processor 160 via user interface 165 include the particular electronic representation 156 to be displayed, the particular type of putting indicia to be displayed, the particular hole and/or course being played, scores for a particular hole, handicaps, putting indicia measured by the user, display and viewing preferences, a user's comments, notes or thoughts about a particular green, hole or course, etc. An illustrative example of an input device is shown in FIG. 12, and includes an input mechanism 178 for selecting the particular hole being played, such as with buttons 180. In FIG. 13, another illustrative example of input device 166 is shown and includes a key pad 182.

Figure 14:
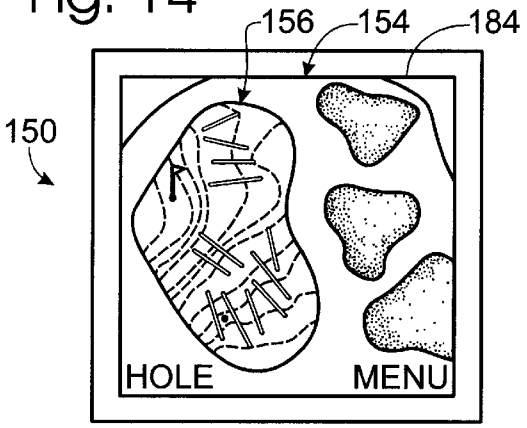
FIG. 14 is a side elevation view showing another example of a user input device.

In FIG. 14, input device 166 and viewing surface 154 are at least partially coextensive, with viewing surface 154 including a touch-sensitive screen 184 through which user inputs may be inputted via contact with the screen. In such an embodiment, the processor may display various menus, options, and other buttons to the user via viewing surface 154. It should be understood that input device 166 may include any or all of the illustrative examples discussed herein, including any other suitable input mechanism for conveying user inputs to processor 160 via user interface 165. User interface 165 typically includes one or more software routines executing on processor 160, however, it may take any suitable form.

As discussed, memory portion 162 may include a nonvolatile region 170 in which data is stored until erased by the user, overwritten by processor 160 or some action other than removing at least temporarily the power supply to the device. Nonvolatile region 170 may include a replaceable cartridge 186 that contains the digital putting information for a particular course or for more than one course. Cartridges 186 may be sold independent of device 150, rented for use on the course, etc. Cartridge 186 may be any suitable data-storage device that may be selectively removed and replaced into device 150, such as via an input port 188 suitable for receiving cartridge 186. Examples of suitable cartridges include computer discs, compact discs, mini discs, data chips, and the like.

Device 150 may additionally, or alternatively, also include a receiver 190 adapted to receive data for temporary or permanent storage in memory portion 162. For example, receiver 190 may communicate via a communication link 192 with a transmitter or transmitting assembly 194, which may include or be in communication with a processor or other computing device. Communication link 192 may be any suitable wired or wireless transmission of data between transmitter 194 and receiver 190. Transmitter 194 may be located either at a particular course or remote from the course. For example, the transmitter may be located at a course, such as at the pro shop, and may be adapted to transmit electronic data containing the putting indicia, electronic representations and the like for a particular course to one or more devices 150. As another example, the transmitter may be located remotely from the course, and users may selectively download the data for a particular course in advance. For example, the data may be transmitted via the Internet, and users may download the particular data prior to playing the course. Continuing this example, a Web site 196 may allow users to selectively download, either for a fee or for free, data for a particular course to devices 150 directly or to a personal computer 198, where the data may be subsequently transferred to device 150, such as via cartridge 186 or a suitable communication link 192.

In some embodiments, the transmitted data may be stored only in volatile memory regions, requiring retransmission of the data every time the device is used for a particular course. An example of a situation where this may be desirable is when a course or other facility either rents devices 150 or charges a per-use fee to use putting indicia and associated data for a particular course. Alternatively, data may be stored in a nonvolatile memory region so that the data may be reused by the user. Similar to a cartridge-based system, this allows the user to use the data for a particular course as many times as the user desires, after initially obtaining the data, such as by purchasing the disk, downloading the data, etc.

Figure 16:
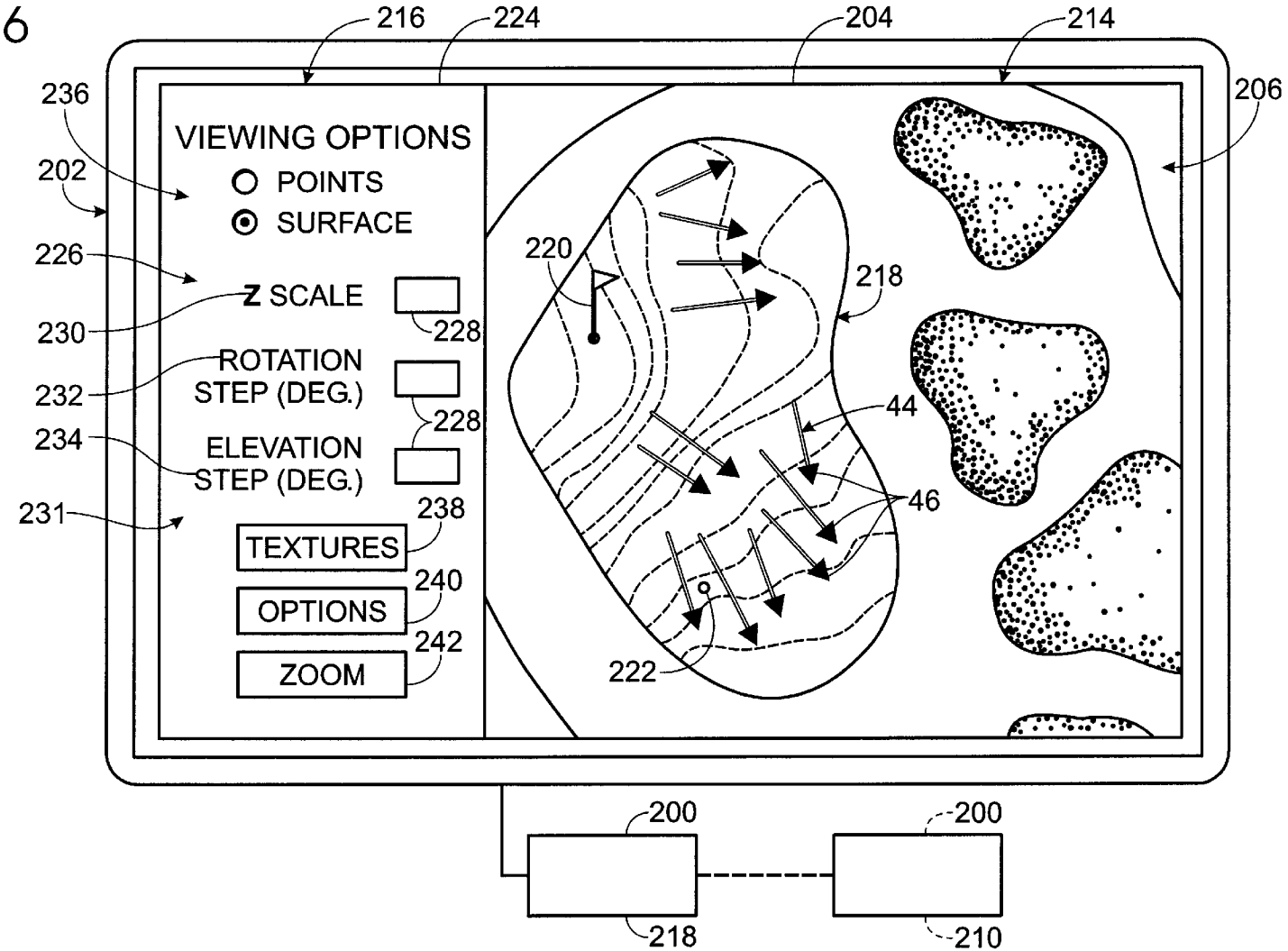
FIG. 16 is a schematic side elevation view of a monitor with a viewing surface showing an exemplary screen display and user interface for another putting improvement device according to the present invention.

Another aspect of the invention is software 200 for allowing a user to view and selectively display the digital putting information. In FIG. 16 a monitor 202 is shown within a viewing surface 204 through which graphic images 206 are displayed to a user. Monitor 202 is adapted to receive a signal containing the graphic images directly or indirectly from a processor 208. For example, monitor 202 may be a computer monitor connected to a personal computer. Alternatively, monitor 202 may be a television set that displays broadcast video from a processor located remote from the television set. In such a configuration, the video may be broadcast locally, regionally, nationally, or internationally via any suitable mechanism, such as air waves, cable, satellite, internet and the like. As another example, monitor 202 and processor 208 may be a hand-held computing device, such as described above at 150.

Graphic images 206 include any of the previously described digital putting information. For example, putting indicia 44 are shown for purposes of illustration as straight putt lines with arrows indicating the direction of elevation change on the represented green. However, any of the other putting indicia described herein, and suggested variants and/or combinations thereof, may be used. Furthermore, software 200, which is executed on processor 208 or on another processor 210 in communication with processor 208, is adapted to enable a user to selectively display and view the representations and putting indicia displayed on the monitor's viewing surface, such as to correspond to a golfer's ball position or to present the representation of the green for viewing at a desired angle and perspective.

An illustrative example of graphic images 206 displayed on viewing surface 204 is shown in FIG. 16. As shown, images 206 include a green region 214 and a control region 216. Green region 214 includes a representation 218 of a green 14 and one or more putting indicia 44. Green region 214 may also, but does not necessarily, include any of the other digital putting information, such as representations of landmarks, green information, speed information, scales, representations of regions around the green, recurring pin positions, approach direction indicators, etc. Green region 214 may also display, through user inputs to control region 216, an actual pin or cup position 220 for the represented green on a particular day, as well as the actual position of one or more golfer's balls 222 on or near the green.

Control region 216 enables a user to selectively adjust and control the images displayed on green region 214 via a user interface 224, through which user inputs are communicated to processor 208 and software 200. As shown in FIG. 16, the user interface includes a scale region 226 adapted to enable a user to select the scale at which the representation 218 of green 14. In FIG. 16, scale region 226 enables user inputs 228 of the Z-axis, or vertical, scale 230. It should be understood that scale region 226 may allow the user to selectively adjust any dimension of the representation and view.

Software 200 may also present green region 214 as a moving or movable image, as opposed to a still image. For example, in FIG. 16, movement region 231 includes a rotation step 232 and an elevation step 234, which respectively allow the user to select the rate at which the images presented on green region 214 are rotated or viewed from different elevations. It should be understood that it is not required that software 200 be adapted to present moving or rotating images. For example, software 200 may present only still images. Also, other user input devices may be used to select the viewing orientation of the images presented in green region 214, such as to manipulate a still image to select a desired viewing orientation. For example, moving a mouse, track ball, joy stick or other device may allow the user to selectively rotate and/or change the elevational perspective of the images. For example, pressing or depressing a control button may toggle between changing the rotation or elevation of the images presented.

Figure 18:
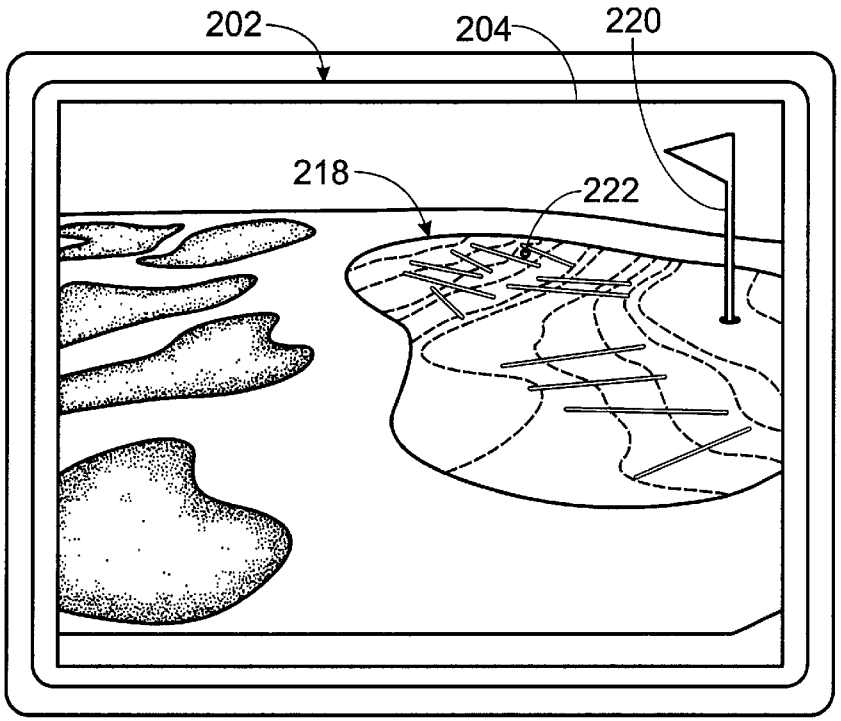
FIG. 18 is a side elevation view showing a player-perspective view of the elevational view of the representation of FIG. 17.
Figure 17:
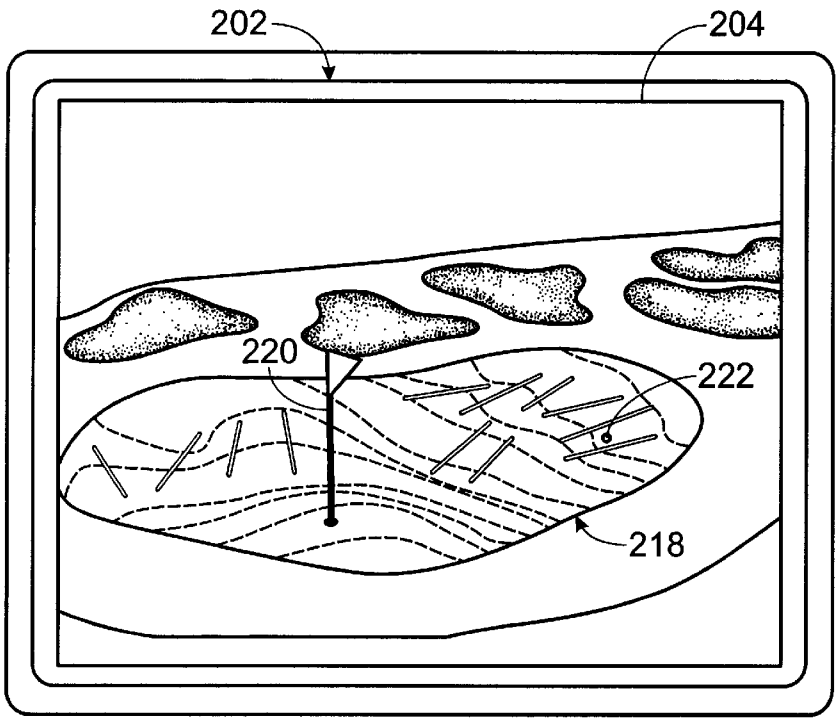
FIG. 17 is a side elevation view showing an elevational view of the overhead green representation shown in FIG. 16.

Also shown is a position region 226 that enables the perspective, or viewing position, from which representation 218 is seen on green region 214. Through user inputs, such as with a keyboard, mouse or other suitable user-input device, the user can select the rotational position of representation 218, such as to orient the representation to correspond to the position of a particular golfer's ball, as well as the elevational position from which the representation is viewed, such as an overhead orientation from above the representation, or a side view, such as would correspond to the view seen by an actual golfer. For example, in FIG. 16, an overhead view of representation 218 is shown, with elevational or player-perspective views shown in FIGS. 17 and 18.

In FIG. 16, a viewing option region 236 is shown, with inputs for points or surface. Selecting "points" displays the actual measured data points that are compiled to create the "surface" view shown in FIG. 16. With the points displayed, the user may selectively add, delete or modify the points, which in turn changes the surface created thereby. For example, if one or more data points are determined to be inaccurate, the erroneous points may be corrected or edited. Similarly, if changes are made to green 14, the data points may be changed to reflect the changes to the actual green represented thereby. Also, new points may be added, such as to add additional putting indicia.

It should be understood that software 200 may include actual empirically measured data from green 14, and then compile this data responsive to user inputs to control region 216 to display in green region representation 218. Alternatively, software 200 may include a previously compiled representation of green 14, such as representation 156, the displayed image of which is manipulated responsive to user inputs to control region 216. An advantage of software including the actual measured data is that it can recompile the green for accurate representation responsive to any user-selected viewing orientation, size, angle, scale, and the like.

Software 200 also enables placement and/or selection of indicia on or near representation 218, such as via user inputs to control region 214. Examples of such indicia, which may also be referred to as specialized or temporary indicia, include the particular pin and cup position 220 for a particular green, such as the position of the pin and cup for a particular day or tournament. Another example of temporary indicia is a particular ball position 222, such as the positions of the golf balls of actual players on or near the represented green.

Referring back to FIG. 16, additional user controls are shown. Input device 238, such as a button, pull down menu or the like, allows the user to select the presentation or appearance of green region 214, such as by selecting the texture and/or color to be used. Input device 240 presents various presentation and viewing options to the user. Input device 242 enables the user to select the relative distance from which representation 218 is viewed, namely, by zooming in or out by a selected amount from the representation currently shown. An example of an option is the selection of a series of viewing orientations or presentations, such as would be displayed on green region 14. For example, software 200 may display in green region 214 a distanced elevational view of the green that closes in on the represented green and then transitions to an overhead view. From this overhead view, for example, one or more player balls 222 may be positioned, and then the view can transition to an elevational, or player-perspective view that shows the green as it would be seen by a player at the placed ball positions.

It should be understood that software described herein may include any or all of the above-described features, and others. It should also be understood that processor 208 may communicate with more than one monitor 202, and that one or more of the monitors may not display control region 216. For example, viewers of a golf tournament may see only green region 214, the content of which is selected by a user interfacing with software 200 and processor 208 to select the images to be displayed to these viewers. For example, the user may orient the representation of a particular green to show the green from an overhead or other elevated view.

Another aspect of the invention is a method for broadcasting golfing events. According to this aspect of the invention, digital puffing data of the putting improvement devices 40 for a particular course are created for broadcast during a broadcast golfing event, such as a tournament, or even a putting contest. When players on the actual course are on or near the green, representation 218 of that particular green is displayed to viewers. In addition the player's ball positions and the current pin position are shown, and viewers are able to see the represented green from the player' perspective. Also, the users may utilize putting indicia 44, alone or in combination with contour lines or shading to demarcate elevations of the green, to "read" the green and determine how the player's ball should be putted. Then, the viewers can watch the actual player putt the ball and see how closely the putted ball corresponds with the viewer's read of the green.

While the invention has been disclosed in its preferred form, the specific embodiments thereof as disclosed and illustrated herein are not to be considered in a limiting sense as numerous variations are possible. To reiterate, green 14 represents one example of a green for which the invented putting improvement device and method may be used, but the invention may be used with any green for which a representation and putting indicia are created, as described herein. Applicant regards the subject matter of the invention to include all novel and non-obvious combinations and subcombinations of the various elements, features, functions and/or properties disclosed herein. Where the claims recite "a" or "a first" element or the equivalent thereof, such claims should be understood to include incorporation of one or more such elements, neither requiring nor excluding two or more such elements.

The following claims define certain combinations and subcombinations that are regarded as novel and non-obvious. Other combinations and subcombinations of features, functions, elements and/or properties may be claimed through amendment of the present claims or presentation of new claims in this or a related application. Such claims, whether they are broader, narrower or equal in scope to the original claims, are also regarded as included within the subject matter of applicant's invention.

I claim:

1. A puffing improvement device, comprising:

a monitor having a viewing surface;

a processor having a memory region; and digital putting information stored in the memory region, wherein the digital puffing information includes a representation of at least one green and a plurality of putting indicia on the representation, wherein each of the putting indicia identifies a determined path along which a golf ball will travel when putted on the green, and wherein the processor is adapted to display the digital putting information on the viewing surface, and further wherein each of the paths is Al determined at least in part by an empirical method that includes measuring the trajectory of a ball propelled along the green.

2. The device of claim 1, further including a user-interface through which user inputs are communicated to the processor.

3. The device of claim 2, wherein the user-interface includes at least one user-input mechanism adapted to receive user inputs, wherein the at least one user-input mechanism is in communication with the user-interface for conveying user inputs to the processor.

4. The device of claim 1, wherein the memory region is adapted to store user inputs.

5. The device of claim 1, further including an input port adapted to receive a cartridge containing digital putting information.

6. The device of claim 1, further including a receiver adapted to receive digital putting information from a source remote from the device.

7. The device of claim 1, wherein the device is a hand-held device adapted to be carried by a user.

8. The device of claim 1, wherein at least one of the putting indicia identifies a straight putt line.

9. The device of claim 1, wherein at least one of the putting indicia identifies a curved putt line.

10. The device of claim 1, wherein at least one of the putting indicia identifies a convergence band identifying a region within which putted golf balls will travel to a common terminal location, wherein the convergence band is bounded by a pair of putting indicia in the form of lines along which a putted golf ball will travel to the common terminal location, and wherein the convergence band further includes a surface extending between the pair of putting indicia in the form of lines.

11. The device of claim 1, wherein each path is determined by measuring the trajectory of a golf ball propelled along the green by a method other than manually propelling the golf ball along the green with a golf club.

12. The device of claim 1, wherein each of the plurality of putting indicia identifies a path along which a golf ball will travel when putted on the green, and wherein each path includes end points beyond which the golf ball will deviate from a linear extension of the path.

13. The device of claim 1, wherein the device further includes an indicator of the average speed of the green.

14. The device of claim 13, wherein the device further includes an indicator of the speed of the green when the plurality of putting indicia were measured.

15. The device of claim 1, wherein the representation includes elevation indicia depicting the topographical profile of the green.

16. The device of claim 1 adapted for use with a green having a predominant grain direction, wherein the device further includes an indicator of the predominant grain direction of the green.

17. The device of claim 1, wherein the putting indicia identify determined paths along which a golf ball will travel when putted on the green, regardless of the direction at which the golf ball is putted along the path.

18. The device of claim 1, wherein each of the putting indicia identifies a determined path along which a golf ball will travel when putted on the green, regardless of the position of the golf ball on the path when the ball is putted along the path.

19. The device of claim 1, wherein each path is determined at least in part from data points obtained using surveying equipment.

20. The device of claim 1, wherein each path is determined by urging a golf ball along the green using a selected reproducible amount of force.

21. A method for improving putting, comprising:

determining a plurality of paths on a green along which a golf ball will travel when putted, wherein the plurality of paths are determined at least in part by an empirical method that includes measuring the trajectory of a ball propelled along the green;

creating digital putting information containing the plurality of paths;

transmitting the digital putting information to a monitor; and displaying the digital putting information on the monitor.

22. The method of claim 21, wherein the digital putting information further includes a representation of the green.

23. The method of claim 21, wherein the digital putting information further includes a representation of a pin on the green.

24. The method of claim 21, wherein the digital putting information further includes a representation of one or more golf balls on the green.

25. The method of claim 21, wherein the monitor is a computer monitor.

26. The method of claim 21, wherein the monitor is a television set.

27. The method of claim 21, wherein the transmitting step includes broadcasting the digital putting information.

28. The method of claim 21, further including receiving one or more user inputs containing and displaying the digital putting information at least in part responsive to the user inputs.

29. The method of claim 28, wherein the user inputs include selection of a viewing angle at which the digital putting information is displayed.

30. The method of claim 28, wherein the user inputs include selection of the perspective from which the digital putting information is displayed.

31. The method of claim 28, wherein the user inputs include information corresponding to placement of one or more golf balls on the green, and further wherein the displaying step includes displaying a representation of the one or more golf balls with the digital putting information.

32. The method of claim 28, wherein the user inputs include the placement of a pin on the green, and further wherein the displaying step includes displaying a representation of the pin along with the digital putting information.

33. The method of claim 28, wherein the user inputs include the scale at which the digital putting information is to be displayed.

34. The method of claim 21, wherein the transmitting step includes transmitting the digital putting information to a plurality of monitors.

35. The method of claim 21, wherein the method further includes repeating the determining, creating, transmitting and displaying steps for a plurality of greens.

36. The method of claim 21, wherein the determining step includes propelling a golf ball along the green and studying the path of the ball to determine if the path meets selected criteria, and further wherein the selected criteria include a straight path of travel.

37. The method of claim 36, wherein the determining step further includes repeating the propelling and studying steps along a different path from a starting position other than a terminal position from a prior determining step if the path fails to meet the selected criteria.

38. The method of claim 36, wherein the determining step further includes repeating the propelling and studying steps with a golf ball propelled along the path with a different force if the path fails to meet the selected criteria.

39. The method of claim 36, wherein the determining step further includes repeating the propelling and studying steps with a golf ball propelled along the path with greater force to determine terminal positions beyond which the path of the golf ball will fail to meet the selected criteria.

40. The method of claim 36, wherein the determining step includes repeating the propelling and studying steps in a different direction along the path to determine if the path meets the selected criteria in the different direction.

41. The method of claim 21, wherein the determining step includes propelling a golf ball along the green other than by manually propelling the golf ball along the green with a golf club.

42. The method of claim 41, wherein the determining step includes propelling the golf ball along the green with a reproducible amount of force.

43. The method of claim 41, wherein at least one of the determining and creating steps includes the use of surveying equipment.

* * * * *

UNITED STATES PATENT AND TRADEMARK OFFICE

CERTIFICATE OF CORRECTION

PATENT NO. : 6,638,173 B2
DATED : October 28, 2003
INVENTOR(S) : Lee D. Robinson It is certified that error appears in the above-identified patent and that said Letters Patent is hereby corrected as shown below:

Column 17,
Line 60, before "improvement device, comprising:" please delete "puffing" and insert -- putting -- therefor.
Line 64, after "wherein the digital" please delete "puffing" and insert -- putting -- therefor.

Column 18,
Line 5, after "further wherein each of the paths is" please delete "A1".

Signed and Sealed this

Twentieth Day of January, 2004

JON W. DUDAS
*Acting Director of the United States Patent and Trademark Office*

US006638173C1

(12) EX PARTE REEXAMINATION CERTIFICATE (8832nd)

United States Patent

Robinson

(10) Number: US 6,638,173 C1

(45) Certificate Issued: *Jan. 31, 2012

(54) PUTTING IMPROVEMENT DEVICES AND METHODS

(75) Inventor: Lee D. Robinson, West Linn, OR (US)

(73) Assignee: The Stracka Design Company LLC, Houston, TX (US)

Reexamination Request:
No. 90/011,634, Apr. 8, 2011

Reexamination Certificate for:

| | |
|---|---|
| Patent No.: | **6,638,173** |
| Issued: | **Oct. 28, 2003** |
| Appl. No.: | **09/931,380** |
| Filed: | **Aug. 15, 2001** |

( * ) Notice: This patent is subject to a terminal disclaimer.

Certificate of Correction issued Jan. 20, 2004.

Related U.S. Application Data

(63) Continuation-in-part of application No. 09/384,931, filed on Aug. 26, 1999, now Pat. No. 6,296,579.

(60) Provisional application No. 60/226,717, filed on Aug. 21, 2000.

(51) Int. Cl.
*A63B 69/36* (2006.01)

(52) U.S. Cl. ..... 473/131; 473/407; 473/409

(58) Field of Classification Search ..... None
See application file for complete search history.

(56) References Cited

To view the complete listing of prior art documents cited during the proceeding for Reexamination Control Number 90/011,634, please refer to the USPTO's public Patent Application Information Retrieval (PAIR) system under the Display References tab.

*Primary Examiner*—Jeffrey R. Jastrzab

(57) ABSTRACT

Methods and devices for improving putting. The device includes a representation of a green on which a plurality of putting benchmarks are projected. The representation may also include elevation indicia and indicators of the speed and predominant grain direction of the green. The device is used to enable golfers to accurately read the green and determine the speed and direction along which a particular ball should be putted. Methods of using and creating the device are also disclosed, as are additional embodiments of putting improvement devices.

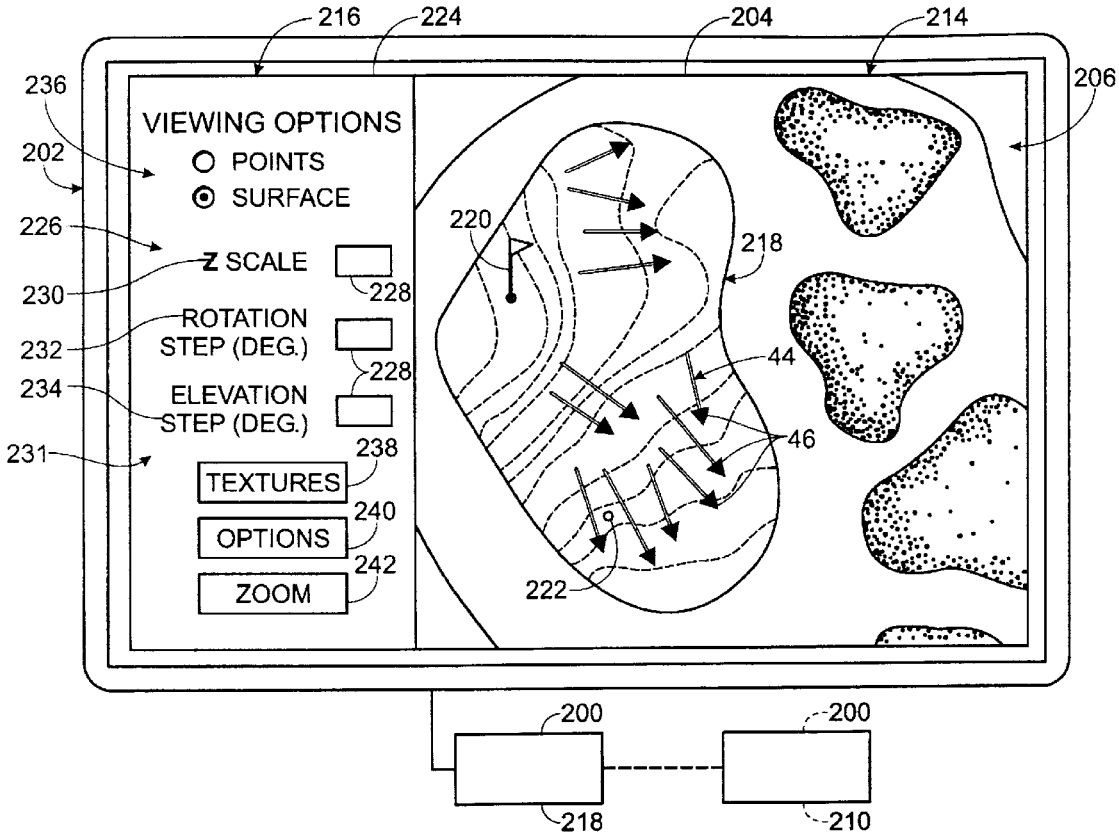

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-43 are cancelled.

New claims 44-59 are added and determined to be patentable.

*44. A method for improving putting comprising: determining a plurality of paths on a green along which a golf ball will travel when putted, the paths being determined at least in part by an empirical method that includes measuring a trajectory of a ball propelled along the green with a device for propelling a golf ball using a reproducible amount of force and wherein the device is not a golf club;*

*determining at least one direction in which a ball must be putt to travel along each of the determined paths;*

*using surveying equipment to obtain survey data comprising data identifying a shape of the green and data identifying a topographical profile of the green, the surveying equipment only requiring one operator for using the equipment;*

*using a computer having software to create a representation of the green using the survey data for the green obtained using the surveying equipment;*

*creating digital putting information containing the plurality of paths, the putting information defining the paths such that some of the paths are representable as straight line putting paths and some of the putting paths are representable as curved line putting paths;*

*transmitting the digital putting infomation to a monitor of an electronic device; and*

*displaying the digital putting information on the monitor, the displaying of the putting information on the monitor comprising:*

*illustrating the representation of the green,*

*illustrating the straight line putting paths and curved line putting paths on the illustrated representation of the green,*

*illustrating contour lines and slope indicia on the representation of the green to illustrate a topographical profile of the green,*

*illustrating at least one indicia identifying a predominant grain direction of the green;*

*illustrating at least one indicia identifying a speed of the green, and*

*illustrating indicia on each of the straight line putting paths and curved putting paths indicating a direction along which a ball must be putt to travel along that path.*

*45. The method of claim 44 wherein the displaying of the putting information on the monitor further comprises illustrating regions of the representation of the green, each of the regions containing indicia correlating to a change in elevation for that region.*

*46. The method of claim 44 wherein the monitor is a component of an electronic device.*

*47. The method of claim 46 wherein the electronic device is selected from the group consisting of a hand-held device, a personal digital assistant, an electronic tablet, a personal computing device, and a computer.*

*48. The method of claim 46 further comprising determining portions of the green along which a ball may be putted that will travel to a common location and wherein the displaying of the putting information on the monitor further comprises illustrating indicia to identify the bands on the representation of the green, each of the indicia identifying the bands identifying a region of the green through which putts will converge to a common location.*

*49. The method of claim 48 wherein the common location is a location identifying a portion of the green where a slope of the green levels out.*

*50. The method of claim 48 wherein the displaying of the putting information on the monitor further comprises illustrating an elevation scale showing an elevation range defined by the contour lines.*

*51. The method of claim 44 wherein the determining of the plurality of paths on the green along which the golf ball will travel when putted comprises:*

*propelling the golf ball along the green and studying a path of travel of the propelled ball to determine if the traveled path meets a selected criteria; and*

*repeating the propelling and studying steps using different amounts of force if the path does not meet the selected criteria, and*

*repeating the propelling and studying steps using a greater amount of force if the path meets the selected criteria to determine terminal positions beyond which the path of the golf ball will fail to meet the selected criteria.*

*52. A putting improvement device comprising:*

*a monitor having a viewing surface;*

*a processor having a memory region; and*

*digital putting information stored in the memory region, wherein the digital putting information includes a representation of at least one green and a plurality of putting indicia for being positioned on the representation, each of the putting indicia identifying a determined path along which a golf ball will travel when putted on the green, the putting information also including topographical profile indicia, each path along which the golf ball will travel when putted on the green being determined at least in part by an empirical method that includes measuring a trajectory of a ball propelled along the green without use of a golf club;*

*the processor being adapted to display the digital putting information on the viewing surface, the displayed digital putting information illustrating the representation of the at least one green, the putting indicia, and the topographical profile indicia;*

*the putting indicia comprising straight line putting lines and curved line putting lines illustrated on the representation of the green when the processor illustrates the representation of the at least one green on the viewing surface, the putting indicia also include indicia for identifying a direction a ball must be putted to move along the curved line and straight line putting lines, the straight line putting lines and curved line putting lines being based on the determined paths; and*

*the topographical profile indicia being illustrated adjacent the representation when the processor displays the representation on the viewing surface, the topographical profile indicia comprising contour lines, slope indicia, and indicia for grain of the green.*

*53. The device of claim 52 wherein the digital putting information also includes information identifying bands on the at least one green in which a ball putted on the green will converge to a common location and wherein indicia for the bands are illustrated on the representation when the processor displays the representation on the viewing surface.*

*54. The device of claim 53 wherein each of the indicia for identifying a direction a ball must be putted to move along the curved line and straight line putting lines includes at least one arrow on the putting line to which that indicia is for, the at least one arrow identifying a direction along which a ball must be putted for the ball to travel along the path identified by the putting line on which the at least one arrow is positioned.*

*55. The device of claim 54 wherein the device is selected from the group consisting of a hand-held device, a personal digital assistant, an electronic tablet, a personal computing device, and a computer.*

*56. The device of claim 52 further comprising a user-interface through which user inputs are communicated to the processor.*

*57. The device of claim 52 further comprising a receiver adapted to receive the digital putting information from a source remote from the device.*

*58. The device of claim 52 wherein the topographical profile indicia is based on data obtained from survey equipment used to obtain survey data of the at least one green.*

*59. The device of claim 52 wherein the monitor is one of a television and a computer monitor.*

* * * * *